US012673840B2

(12) United States Patent
Ube

(10) Patent No.: US 12,673,840 B2
(45) Date of Patent: Jul. 7, 2026

(54) DRIVING DEVICE

(71) Applicant: BROTHER KOGYO KABUSHIKI KAISHA, Nagoya (JP)

(72) Inventor: Tetsuharu Ube, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 12 days.

(21) Appl. No.: 18/989,709

(22) Filed: Dec. 20, 2024

(65) Prior Publication Data

US 2025/0206542 A1 Jun. 26, 2025

(30) Foreign Application Priority Data

Dec. 26, 2023 (JP) ..... 2023-220113

(51) Int. Cl.
*B65H 29/20* (2006.01)
*B65H 3/06* (2006.01)
*B65H 29/12* (2006.01)

(52) U.S. Cl.
CPC ..... *B65H 29/20* (2013.01); *B65H 3/0669* (2013.01); *B65H 29/12* (2013.01); *B65H 2403/81* (2013.01)

(58) Field of Classification Search
CPC ..... B65H 3/0669; B65H 29/12; B65H 29/20; B65H 2403/81; B65H 2555/13; G03G 15/6552
See application file for complete search history.

(56) References Cited

U.S. PATENT DOCUMENTS

2010/0096797 A1* 4/2010 Chen ..... F16H 3/40 74/335
2014/0291923 A1* 10/2014 Hashimoto ..... B65H 5/062 271/225
2017/0371288 A1 12/2017 Hashimoto
2019/0072164 A1* 3/2019 Tokoro ..... F16H 29/12

FOREIGN PATENT DOCUMENTS

JP 2006-266400 A 10/2006
JP 2007-064343 A 3/2007
JP 2014-199366 A 10/2014
JP 2017-227280 A 12/2017

* cited by examiner

*Primary Examiner* — Prasad V Gokhale
(74) *Attorney, Agent, or Firm* — Kenealy Vaidya LLP

(57) ABSTRACT

A driving device includes a conveyer roller, a solenoid, a lever including a boss, a first gear, a pendulum gear, and a frame including a supporting shaft. The lever is engageable with the solenoid and is movable between a first position and a second position. The pendulum gear is movable in conjunction with movement of the lever between a third position, at which the pendulum gear meshes with the first gear, and a fourth position, at which the pendulum gear is disengaged from the first gear. The supporting shaft is inserted in the boss of the lever. The supporting shaft includes a first contact portion and a second contact portion contacting the boss of the lever, and a separated portion spaced from an inner circumferential surface of the boss and located between the first contact portion and the second contact portion.

9 Claims, 12 Drawing Sheets

DRIVING DEVICE

REFERENCE TO RELATED APPLICATIONS

This application claims priority from Japanese Patent Application No. 2023-220113, filed on Dec. 26, 2023. The entire content of the priority application is incorporated herein by reference.

BACKGROUND ART

An image forming apparatus capable of forming images on both sides of a sheet is known. Such an image forming apparatus may have a driving device including a solenoid that may switch rotating directions of a sheet-ejection roller to convey a sheet.

The driving device may have a lever movable between a first position, at which the lever is pulled by a pulling effect of the solenoid, and a second position, at which the lever is released from the pulling effect of the solenoid. The driving device may operate such that, for example, when the lever is located at the second position, the sheet-ejection roller rotates in a forward direction, and when the lever is located at the first position, the sheet-ejection roller rotates in a reverse direction.

The sheet-ejection roller rotating in the forward direction may convey the sheet, with an image formed on one side thereof, toward a sheet-ejection tray. The sheet-ejection roller rotating in the reverse direction may convey the sheet, with an image formed on one side thereof, toward an image forming device. The lever may be movably supported by a member of the image forming apparatus such as a frame.

SUMMARY

In recent years, as driving devices tend to be downsized, smaller-sized solenoids are demanded. However, when a solenoid is downsized, an attraction force to move the lever may be lowered. Therefore, when a force, such as a friction force between the lever and the member supporting the lever, that may inhibit the lever from moving is large, the lever may not be moved smoothly or substantially by the solenoid.

The present disclosure relates to a driving device that may move a lever smoothly even with a downsized solenoid.

According to an aspect of the present disclosure, a driving device includes a conveyer roller, a solenoid, a lever, a first gear, a pendulum gear, and a frame. The conveyer roller extends in an axial direction. The lever is engageable with the solenoid and is movable between a first position, at which the lever is pulled by a pulling effect of the solenoid, and a second position, at which the lever is released from the pulling effect of the solenoid. The lever includes a boss protruding in the axial direction. The first gear is configured to transmit a driving force to the conveyer roller. The pendulum gear is movable in conjunction with movement of the lever between a third position, at which the pendulum gear meshes with the first gear, and a fourth position, at which the pendulum gear is disengaged from the first gear. The frame includes a supporting shaft. The supporting shaft extends along the axial direction and is inserted in the boss of the lever. The supporting shaft includes a first contact portion, a second contact portion, and a separated portion. The first contact portion contacts the boss of the lever. The second contact portion contacts the boss of the lever and is separated from the first contact portion in the axial direction. The separated portion is spaced from an inner circumferential surface of the boss and located between the first contact portion and the second contact portion.

DESCRIPTION

Hereinbelow, an embodiment of the present disclosure will be described below with reference to the accompanying drawings.

Figure 1:
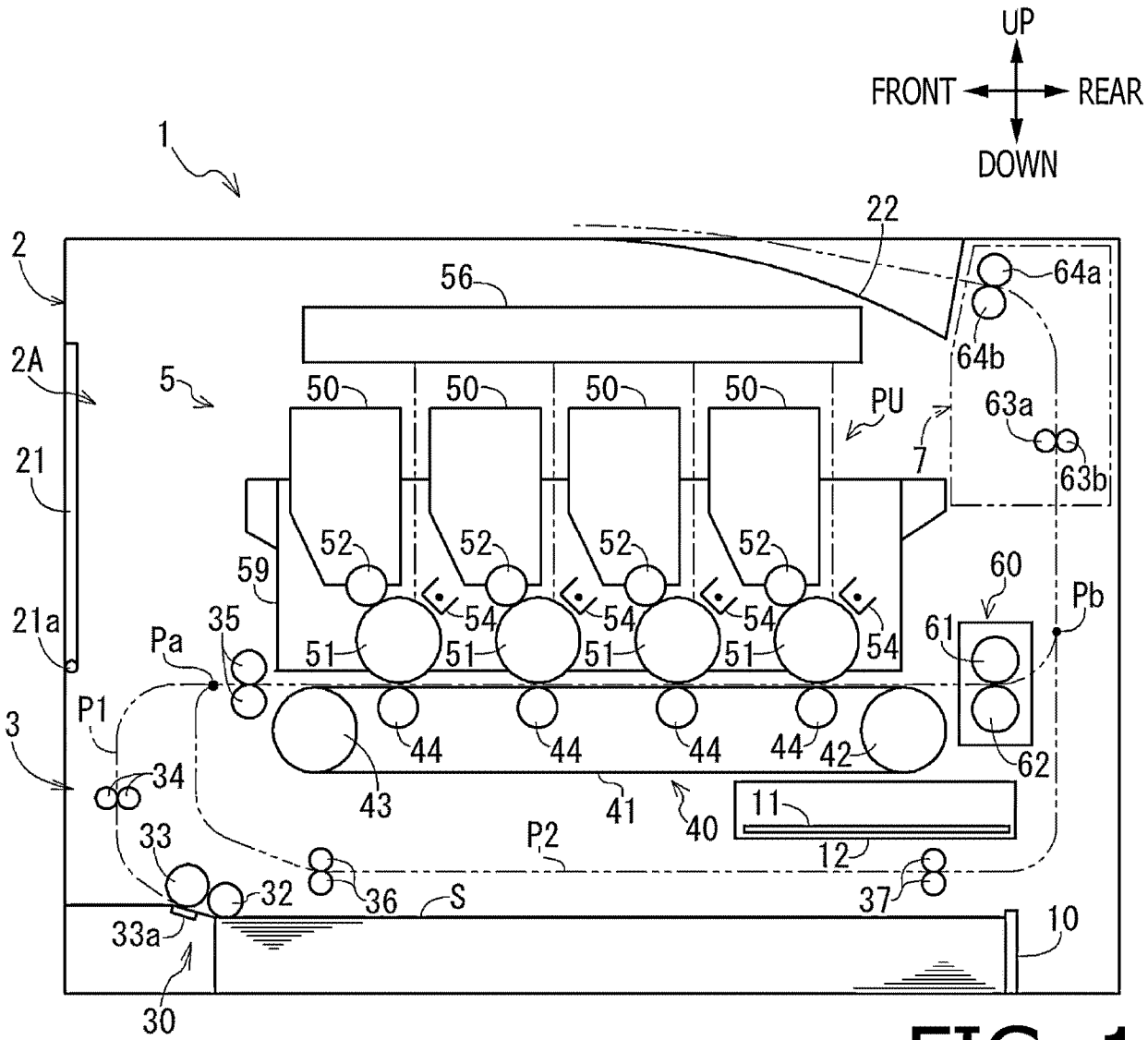
FIG. 1 is an overall cross-sectional view of an image forming apparatus.

An image forming apparatus 1 as shown in FIG. 1 is a multicolor laser printer capable of forming images in multiple colors electro-photographically on sheets including the driving device as an embodiment of the present disclosure.

In the description below, directions in the image forming apparatus 1 are defined based on an orientation shown in FIG. 1, as indicated up, down, right, left, front, and rear by bi-directionally pointing arrows in FIG. 1. In other words, a leftward side and a rightward side in FIG. 1 to a viewer are defined as a frontward side and a rearward side of the image forming apparatus 1, respectively, and a nearer side and a farther side in FIG. 1 to the viewer are defined as a rightward side and a leftward side of the image forming apparatus 1, respectively. An upper side and a lower side in FIG. 1 to the viewer are defined as an upper side and a lower side of the image forming apparatus 1, respectively. A front-to-rear or rear-to-front direction may be called a front-rear direction, and an up-to-down or down-to-up direction may be called a vertical direction. A left-to-right or right-to-left direction may be called a widthwise direction.

The image forming apparatus 1 includes a body 2, a sheet feeder 3 including a sheet-feeder tray 10 to support sheets S, a sheet conveyer 30 to convey the sheets S, and an image forming device 5.

The body 2 has a shape of an approximately rectangular parallelepiped and accommodates the sheet feeder 3 and the image forming device 5. On a front side of the body 2, a frontward opening 2A is formed, and the body 2 has a front cover 21 to close or open the frontward opening 2A.

The front cover 21 is pivotable about a pivot shaft 21*a* at a lower end thereof. By pivoting about the pivot shaft 21*a*, the front cover 21 moves between a closing position, at which the front cover 21 closes the frontward opening 2A, and an opening position, at which the front cover 21 opens the frontward opening 2A. On an upper side of the body 2, a sheet-ejection tray 22, declining to be lower from the front side toward the rear side, is formed.

The sheet feeder 3 is located at a lower area in the body 2 and may convey the sheets S supported on the sheet-feeder tray 10 by the sheet conveyer 30 to the image forming device 5. The sheet-feeder tray 10 is slidable in the front-rear direction to move between a stowed position, at which the sheet-feeder tray 10 is stowed in the body 2, and a detached position, at which the sheet-feeder tray 10 is drawn frontward from the detached position.

The sheet conveyer 30 includes a feed roller 32 a separation roller 33, a separation pad 33*a*, a conveyer roller pair 34, and a registration roller pair 35. Inside the body 2, a conveyer path P1 is formed for the sheet S to travel therein from the sheet-feeder tray 10 through the image forming device 5 to the sheet-ejection tray 22.

The sheets S on the sheet-feeder tray 10 are separated from one another by the feed roller 32, the separation roller 33, and the separation pad 33*a* and fed to the conveyer path P1. The feed roller 32 is a roller for conveying the sheet S from the sheet-feeder tray 10 toward the image forming device 5. The separation roller 33 and the separation pad 33*a* compose a separator for separating one of the sheets S supported on the sheet-feeder tray 10 from the other.

The sheet S fed to the conveyer path P1 is conveyed by the conveyer roller pair 34 and the registration roller pair 35 toward the image forming device 5. The registration roller pair 35 regulates movement the sheet S being conveyed by causing a leading edge of the sheet S to pause temporally, and resumes conveying the sheet S at a predetermined timing toward the image forming device 5.

The image forming device 5 is located above the sheet feeder 3 and includes four toner cartridges 50 aligned in the front-rear direction and photosensitive drums 51 corresponding to the toner cartridges 50 on one-to-one basis. Each toner cartridge 50 is provided to correspond to one of colors of black, yellow, magenta, and cyan. The toner cartridges 50 are removably supported by a drawer 59. The drawer 59 is detachable from or attachable to the body 2 through the frontward opening 2A formed in the body 2 while the front cover 21 is open. Each toner cartridge 50 includes a developing roller 52.

Each photosensitive drum 51 is formed to have a cylindrical shape, of which axis extends in the widthwise direction, and is rotatably supported by the drawer 59. The developing rollers 52 extend in the widthwise direction and are rotatably supported by the respective toner cartridges 50. The developing rollers 52 supply toner to the respective photosensitive drums 51. The toner is an example of a developing agent.

The body 2 includes an exposure device 56 for irradiating surfaces of the photosensitive drums 51 with light beams. The exposure device 56 includes laser diodes, polarizers, lenses, and mirrors, which are not shown. The exposure device 56 may emit the light beams at the photosensitive drums causing the surfaces of the photosensitive drums to be exposed to the light.

At a position below the photosensitive drums 51 across the conveyer path P1, a transfer belt 41 is arranged to face and contact the photosensitive drums 51. The transfer belt 41 is strained around a driving roller 42 and a driven roller 43 located frontward with respect to the driving roller 42. At positions toward the photosensitive drums 51 across the transfer belt 41, transfer rollers 44 are arranged. In the image forming device 5, the transfer belt 41, the driving roller 42, the driven roller 43, and the transfer rollers 44 compose a belt unit 40.

The image forming device 5 includes chargers 44 for charging the photosensitive drums 51. The chargers 54 are supported by the drawer 59. The photosensitive drums 51 charged evenly by the chargers 54 may be selectively exposed to the light from the exposure device 56, and potentials may be selectively removed from the surfaces of the photosensitive drums 51, and thereby electrostatic latent images are formed on the surfaces of the photosensitive drums 51.

Meanwhile, the toner contained in each toner cartridge 50 is positively charged and carried on the surface of the developing roller 52, to which developing bias is applied. As the electrostatic latent image formed on the photosensitive drum 51 faces the developing roller 52, due to the potential difference between the electrostatic latent image and the developing roller 52, the toner is supplied from the developing roller 52 to the electrostatic latent image. As such, a toner image is formed on the surface of the photosensitive drum 51.

When the sheet S conveyed to the image forming device 5 reaches the transfer belt 41, the transfer belt 41 conveys the sheet S further, and the sheet S passes through the position between the transfer belt 41 and the photosensitive drums 51. The toner images carried on the surfaces of the photosensitive drums 51 are transferred to the sheet S when the sheet S faces the photosensitive drums 51 one after another by the transfer bias applied to the transfer rollers 4.

The transfer belt 41 in the present embodiment is in a form of a conveyer belt configured to convey the sheet S, and the toner images re transferred onto the sheet S being conveyed thereon. Optionally, however, the transfer belt may be in a form of an intermediate transfer belt, onto which the toner images are primarily transferred, and the toner images may be secondarily transferred from the belt to the sheet S.

The sheet S with the toner images transferred thereon is conveyed to a fuser 60. The fuser 60 includes a heat roller 61 and a pressure roller 62 pressed against the heat roller 61. As the sheet S reaching the fuser 60 is conveyed through a position between the heat roller 61 and the pressure roller 62, the toner images are thermally fused and fixed onto the sheet S. In other words, the fuser 60 may fix the toner images onto the sheet S.

The sheet S with the toner images thermally fixed thereon is further conveyed downstream in a conveying direction from the fuser 60. On a downstream side from the fuser 60 in the conveying direction, an intermediate sheet-ejection roller 63*a* and a driven roller 63*b* facing the intermediate sheet-ejection roller 63*a* are arranged. On a downstream side from the intermediate sheet-ejection roller 63*a* and the driven roller 63*b* in the conveying direction, a sheet-ejection roller 64*a* and a driven roller 64*b* facing the sheet-ejection roller 64*a* are arranged.

The sheet S conveyed downstream in the conveying direction from the fuser 60 is conveyed by the intermediate sheet-ejection roller 63*a* and the driven roller 63*b* and further by the sheet-ejection roller 64*a* and the driven roller 64*b* to be ejected at the sheet-ejection tray 22.

In the image forming apparatus 1, the drawer 59 and the components supported by the drawer 59 including the toner cartridges 50, the photosensitive drums 51, and the chargers 54 compose a process unit PU for forming the toner images on the sheet S. It may be noted that the composition of the process unit PU may not necessarily be limited as long as the photosensitive drum 51 and the charger 54 are included, and for example, the transfer belt 41 and/or the fuser 60 may be included as parts of the process unit PU.

The image forming apparatus 1 further includes a power board 11, on which a power circuit is formed, and a board cover 12 that covers the power board 11. The board cover 12 is located between the sheet-feeder tray 10 and the belt unit 40 in a rearward area in the body 2. The body 2 accommodates the process unit PU and the board cover 12.

The sheet-ejection roller 64*a* and the intermediate sheet-ejection roller 63*a* are each rotatably supported by the body 2 in a posture such that an axial direction thereof coincides with the widthwise direction. The sheet-ejection roller 64*a* and the intermediate sheet-ejection roller 63*a* are elongated along the axial direction. The sheet-ejection roller 64*a* is an example of the conveyer roller.

The sheet-ejection roller 64*a* and the intermediate sheet-ejection roller 63*a* are rotatable in a forward direction, in which the sheet-ejection roller 64*a* and the intermediate sheet-ejection roller 63*a* convey the sheet S toward the sheet-ejection tray 22, and a reverse direction, which is an opposite direction to the forward direction. The image forming apparatus 1 has a duplex conveyer path P2 to guide the sheet S conveyed along the conveyer path P1 and exited the fuser 6 to a position in the conveyer path P1 upstream from the registration roller pair 35 in the conveying direction.

The duplex conveyer path P2 branches off from the conveyer path P1 at a branch point Pb located between the fuser 6 and the intermediate sheet-ejection roller 63*a*, extends frontward in an area between the board cover 12 and the sheet-feeder tray 10, and merges with the conveyer path P1 at a merge point Pa located between the conveyer roller pair 34 and the registration roller pair 35.

The sheet S conveyed from the fuser 6 to the sheet-ejection roller 64*a* may be fed once again to the image forming device 5 through the duplex conveyer path P2 by the sheet-ejection roller 64*a* and the intermediate sheet-ejection roller 63*a* rotating in the reverse direction. The sheet S conveyed to the duplex conveyer path P2 by the sheet-ejection roller 64*a* and the intermediate sheet-ejection roller 63*a* is conveyed toward the image forming device 5 by a first duplex conveyer roller pair 36 and a second duplex conveyer roller pair 37 located on the duplex conveyer path P2.

As such, the image forming apparatus 1 may perform double-face printing, in which an image is formed on one side of the sheet S by the image forming device 5, the sheet S is conveyed to the image forming device 5 once again through the duplex conveyer path P2, and another image is formed on the other side of the sheet S by the image forming device 5.

Driving Device

As shown in FIG. 1, the image forming apparatus 1 includes a driving device 7 for switching the rotating direction of the sheet-ejection roller 64*a* and the intermediate sheet-ejection roller 63*a* between the forward direction and the reverse direction. The driving device 7 is located at an area on a leftward and rearward end in the body 2.

Figure 2:
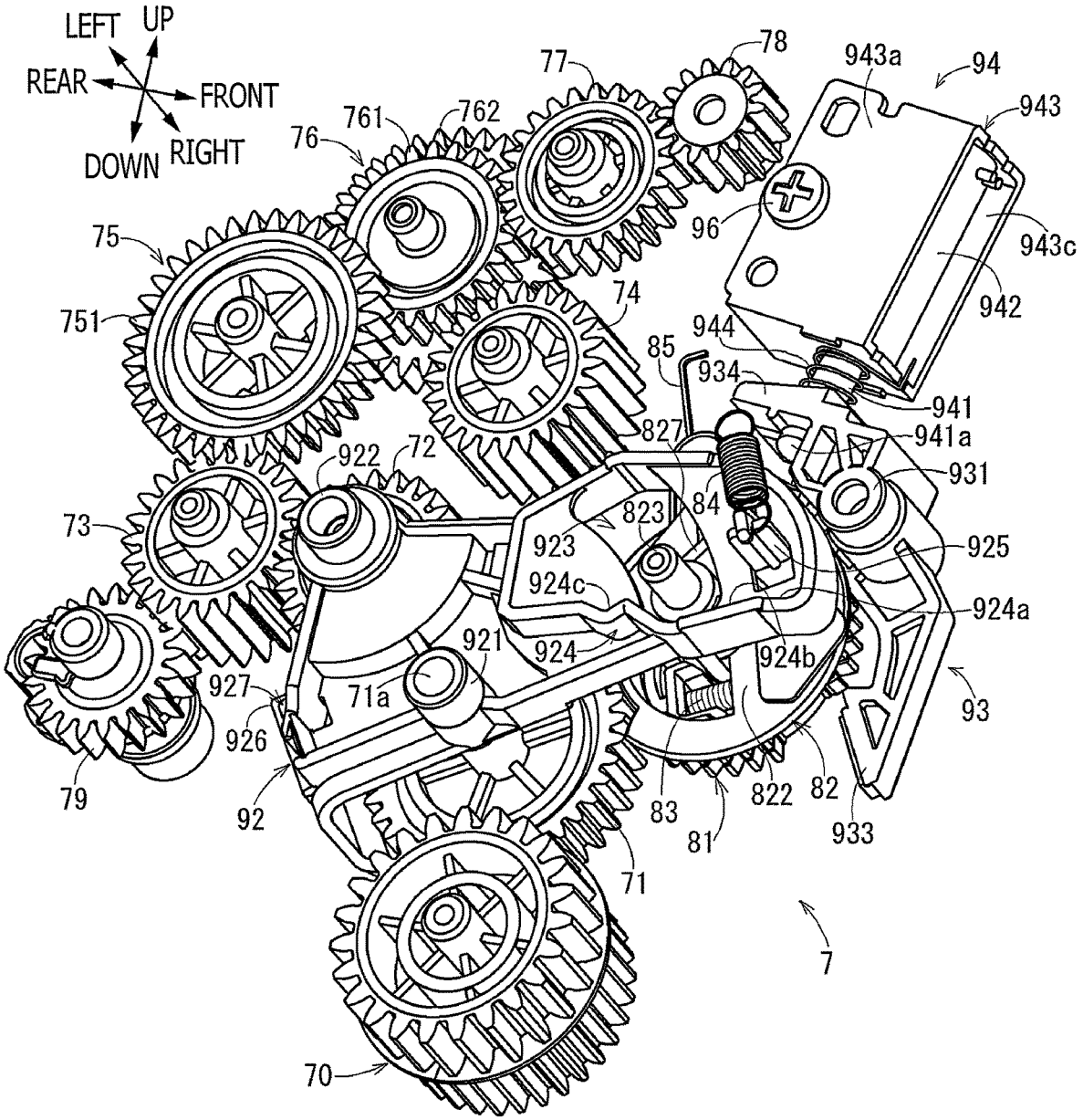
FIG. 2 is a perspective view of a driving device.
Figure 3:
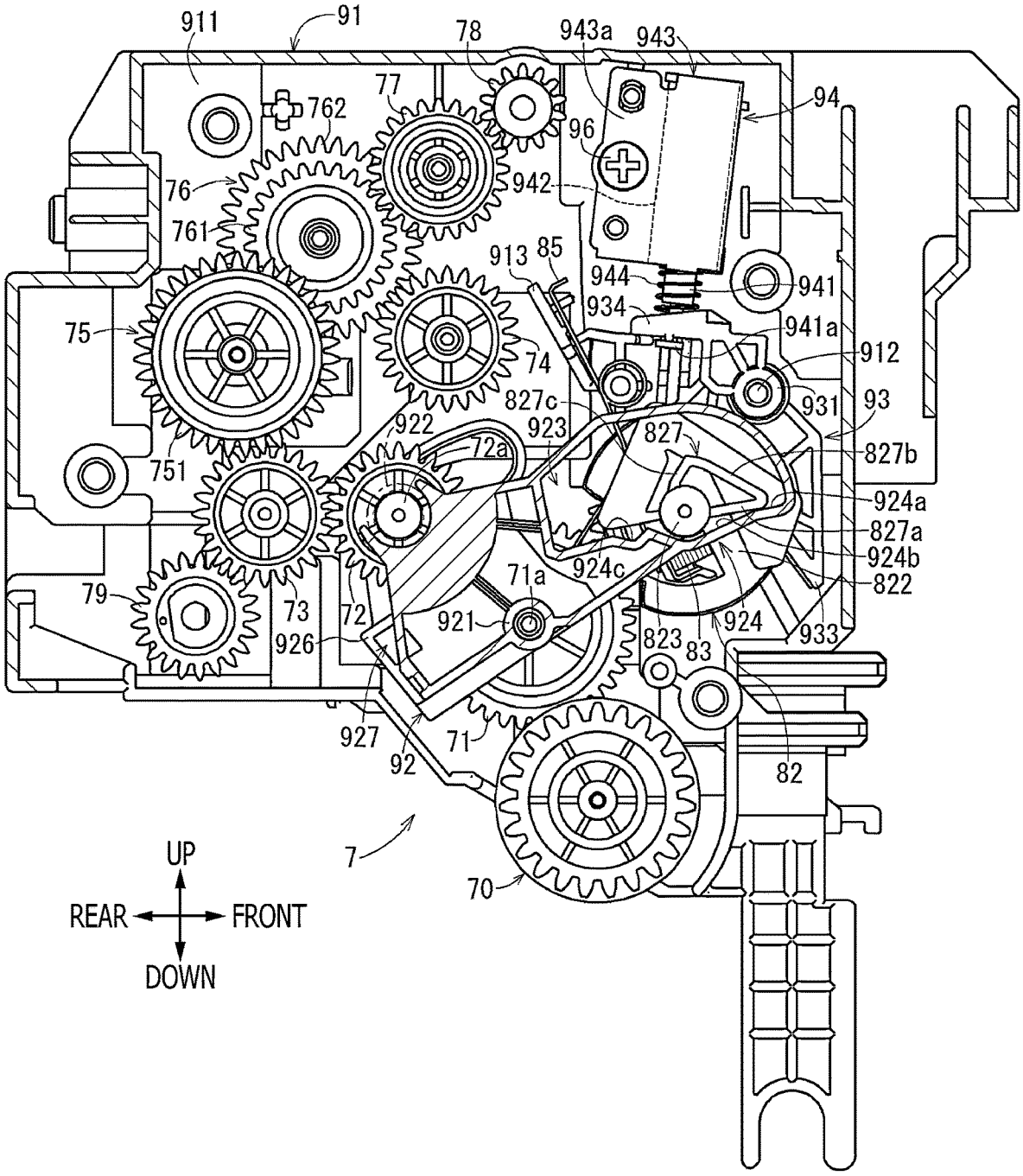
FIG. 3 is a leftward side view of the driving device.
Figure 4:
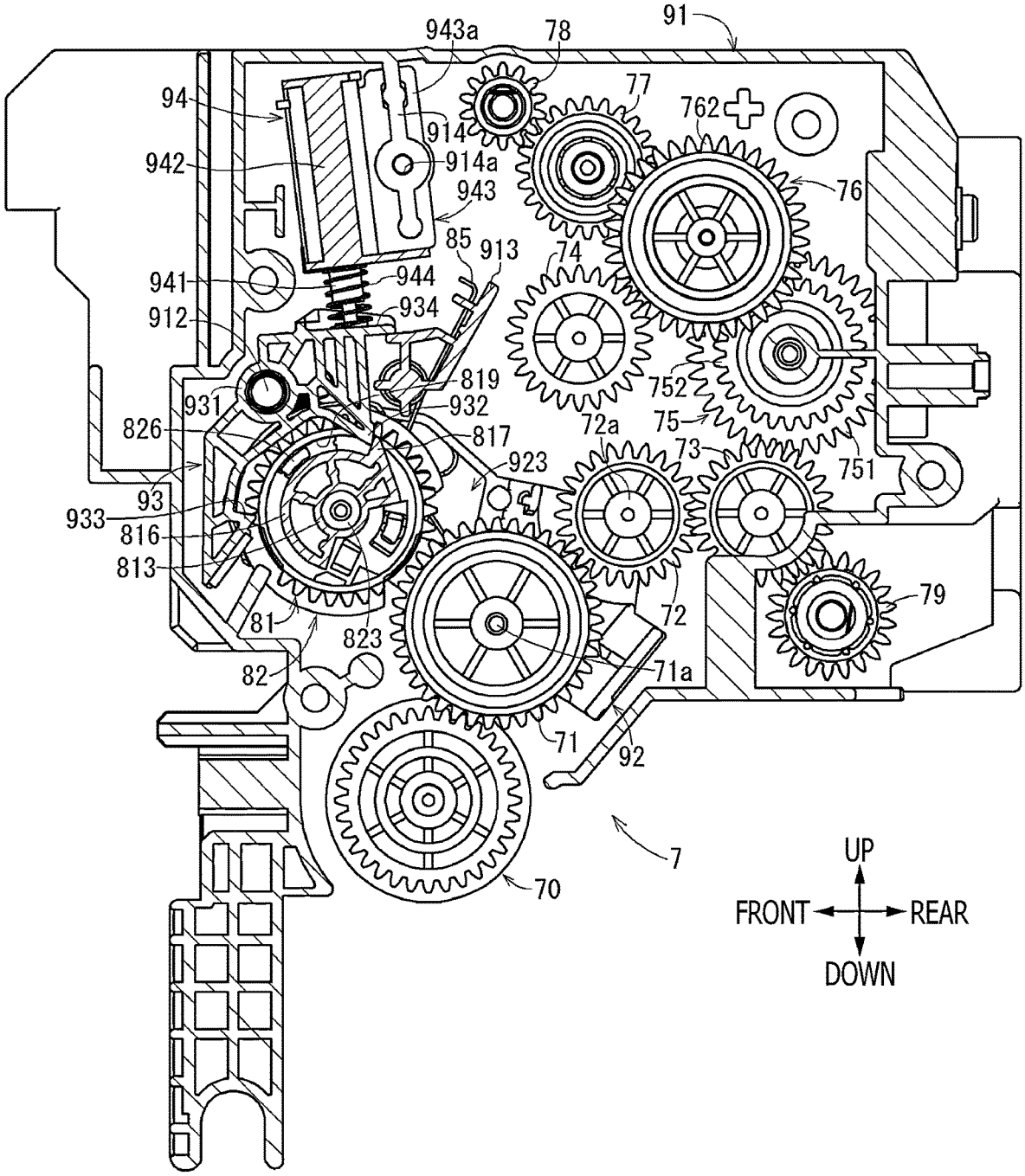
FIG. 4 is a rightward side view of the driving device.

As shown in FIGS. 2-4, the driving device 7 includes a gear frame 91 (FIGS. 3-4) and gears 70-79. The gears 70-79 includes, in particular, an input gear 70, a driving gear 71, a pendulum gear 72, a first intermediate input gear 73, a second intermediate input gear 74, a first idle gear 75, a second idle gear 76, a third idle gear 77, a sheet-ejection roller gear 78, and an intermediate sheet-ejection roller gear 79. The first intermediate input gear 73 is an example of the first gear configured to transmit a driving force to the conveyer roller. The driving gear 71 is an example of the second gear configured to be driven by the driving force input thereto.

The gear frame 91 includes a supporting wall 911 spreading in the front-rear direction and the vertical direction. The supporting wall 911 faces sideward in the widthwise direction. The gear frame 91 is supported by the body 2. The gear frame 91 is a gear cover to cover the gears 70-79.

The gears 70-79 except the pendulum gear 72, namely, the input gear 70, the driving gear 71, the first intermediate input gear 73, the second intermediate input gear 74, the first idle gear 75, the second idle gear 76, the third idle gear 77, the sheet-ejection roller gear 78, and the intermediate sheet-ejection roller gear 79 are rotatably supported by the supporting wall 911 of the gear frame 91 in an orientation such that rotation axes thereof align with the widthwise direction. The gears 70-79 are located on a leftward side of the supporting wall 911.

To the input gear 70, a driving force from a driving source in the image forming apparatus 1 is input. The input gear 70 meshes with the driving gear 71, and the driving force may be input from the input gear 70 to the driving gear 71.

The pendulum gear 72 meshes with the driving gear 71. The first intermediate input gear 73 and the second intermediate input gear 74 are engageable with the pendulum gear 72.

The pendulum gear 72 is movable between a third position, at which the pendulum gear 72 meshes with the first intermediate input gear 73, and a fourth position, at which the pendulum gear 72 meshes with the second intermediate input gear 74. In a state where the pendulum gear 72 is at the third position and meshes with the first intermediate input gear 73, the pendulum gear 72 is separated from the second intermediate input gear 74. In a state where the pendulum gear 72 is at the fourth position and meshes with the second intermediate input gear 74, the pendulum gear 72 is separated from the first intermediate input gear 73.

The first idle gear 75 is a two-step gear, in which a larger-diameter gear 751 having a relatively large diameter and a smaller-diameter gear 752 having a relatively small diameter are stacked in tiers. The larger-diameter gear 751 meshes with the first intermediate input gear 73.

The second idle gear 76 is a two-step gear, in which a smaller-diameter gear 761 having a relatively small diameter and a larger-diameter gear 762 having a relatively large diameter are stacked in tiers. The larger-diameter gear 762 meshes with the second intermediate input gear 74.

The third idle gear 77 meshes with the smaller-diameter gear 761 of the second idle gear 76. The sheet-ejection roller gear 78 meshes with the third idle gear 77. The sheet-ejection roller gear 78 is connected to the sheet-ejection roller 64*a* and is rotatable integrally with the sheet-ejection roller 64*a*. The sheet-ejection roller gear 78 is an example of the output gear configured to be driven by the driving force transmitted from the first gear and connected to the conveyer roller.

The intermediate sheet-ejection roller gear 79 meshes with the first intermediate input gear 73. The intermediate sheet-ejection roller gear 79 is connected to the intermediate sheet-ejection roller 63*a* and is rotatable integrally with the intermediate sheet-ejection roller 63*a*.

When the pendulum gear 72 is at the third position and meshes with the first intermediate input gear 73, the driving force input from the input gear 70 to the driving gear 71 is transmitted to the sheet-ejection roller 64*a* through the pendulum gear 72, the first intermediate input gear 73, the first idle gear 75, the second idle gear 76, the third idle gear 77, and the sheet-ejection roller gear 78. The sheet-ejection roller 64*a*, to which the driving force is transmitted, may rotate in the forward direction.

When the pendulum gear 72 is at the third position and meshes with the first intermediate input gear 73, moreover, the driving force input from the input gear 70 to the driving gear 71 is transmitted to the intermediate sheet-ejection roller 63*a* through the pendulum gear 72, the first intermediate input gear 73, and the intermediate sheet-ejection roller gear 79. The intermediate sheet-ejection roller 63*a*, to which the driving force is transmitted, may rotate in the forward direction.

When the pendulum gear 72 is at the fourth position and meshes with the second intermediate input gear 74, the driving force input from the input gear 70 to the driving gear 71 is transmitted to the sheet-ejection roller 64*a* through the pendulum gear 72, the second intermediate input gear 74, the second idle gear 76, the third idle gear 77, and the sheet-ejection roller gear 78. The sheet-ejection roller 64*a*, to which the driving force is transmitted, may rotate in the reverse direction.

When the pendulum gear 72 is at the fourth position and meshes with the second intermediate input gear 74, moreover, the driving force input from the input gear 70 to the driving gear 71 is transmitted to the intermediate sheet-ejection roller 63*a* through the pendulum gear 72, the second intermediate input gear 74, the second idle gear 76, the first idle gear 75, the first intermediate input gear 73, and the intermediate sheet-ejection roller gear 79. The intermediate sheet-ejection roller 63*a*, to which the driving force is transmitted, may rotate in the reverse direction.

The driving device 7 includes a first sector gear 81, a second sector gear 82, a switch arm 92, a lever 93, and a solenoid 94. The pendulum gear 72 is selectively engageable with either the first intermediate input gear 73 or the second intermediate input gear 74 through the first sector gear 81, the second sector gear 82, the switch arm 92, the lever 93, and the solenoid 94.

First Sector Gear

Figure 5:
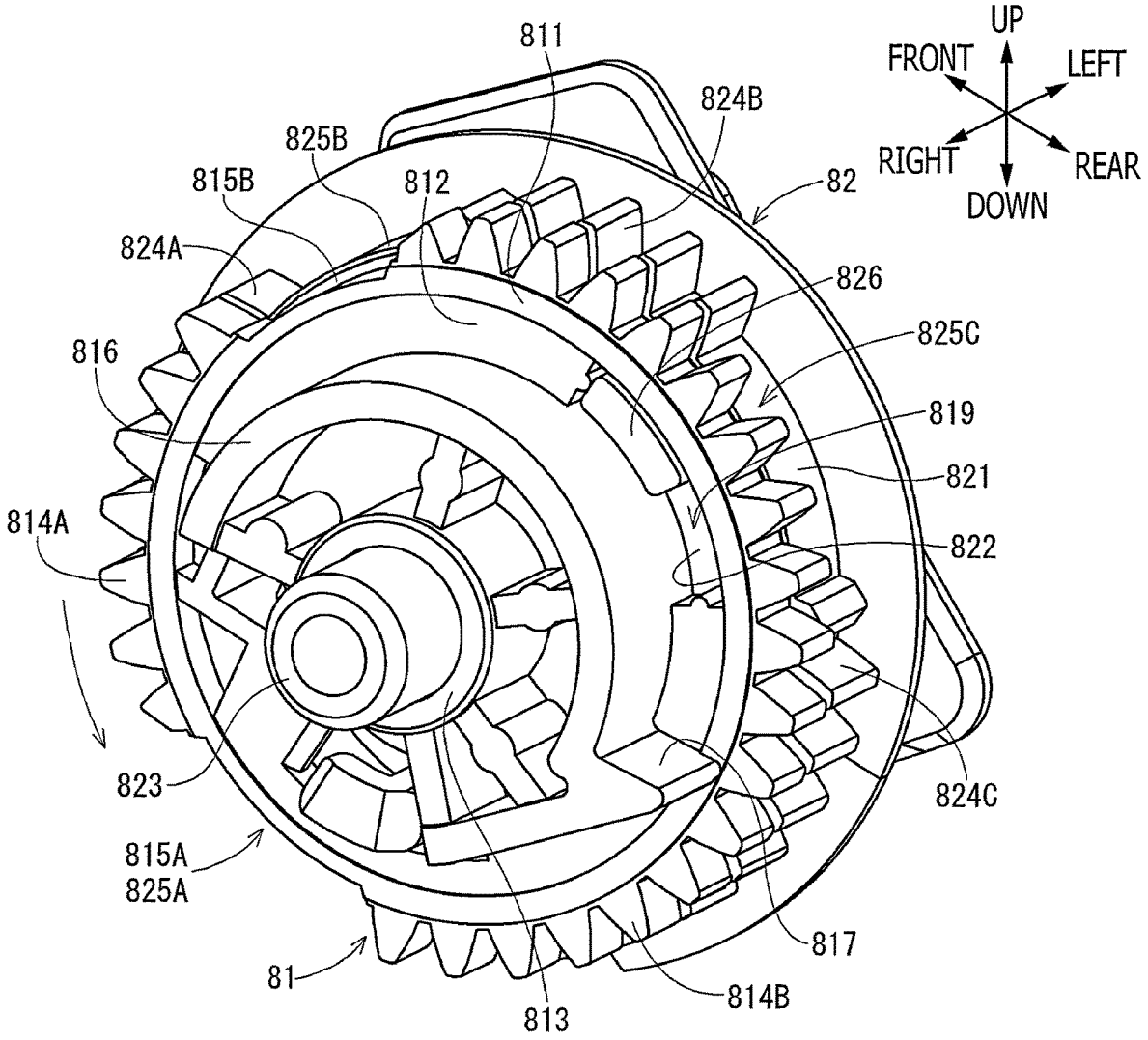
FIG. 5 is a perspective view of a first sector gear and a second sector gear.
Figure 6:
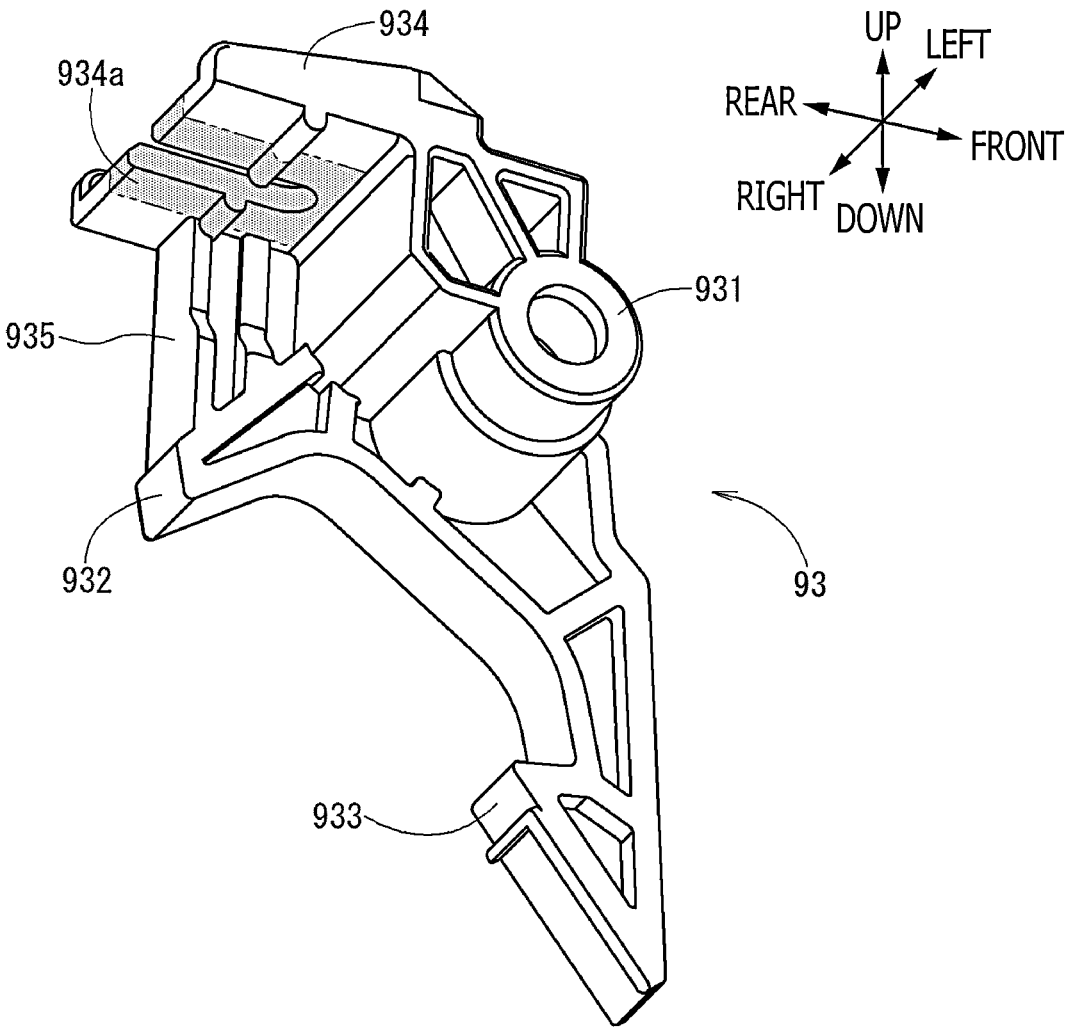
FIG. 6 is a perspective view of a lever.

As shown in FIG. 5, the first sector gear 81 is arranged in an orientation such that a direction of a rotation axis thereof aligns with the widthwise direction and is rotatable counterclockwise in a view from the right. The first sector gear 81 includes a rim 811, a web 812, and a boss 813.

The rim 811 is formed in a short cylindrical shape. On an outer circumferential surface of the rim 811, first teeth portions 814A, 814B, each including a plurality of gear teeth, are formed. The first teeth portion 814A and the first teeth portion 814B are arranged along a circumferential direction of the rim 811. Between the first teeth portion 814A and the first teeth portion 814B, first toothless portions 815A, 815B which lack gear teeth, is formed. The first teeth portions 814A, 814B are examples of the teeth portions engageable with the second gear.

In the rotating direction of the first sector gear 81, the first toothless portion 815A is located between a downstream end of the first teeth portion 814A and an upstream end of the first teeth portion 814B, and the first toothless portion 815B is located between an upstream end of the first teeth portion 814A and a downstream end of the first teeth portion 814B.

The web 812 is formed in a substantially annular shape extending from an inner peripheral surface of the rim 811 toward a center of the first sector gear 81. At a central position in a radial direction of the web 812, an engageable wall 816 extending rightward in a shape of a substantially semicircular arc is formed. The engageable wall 816 includes an engageable portion 817 protruding outward in the radial direction.

In the web 812, at a position between the engageable wall 816 and the rim 811, an elongated hole 819 is formed. The elongated hole 819 is formed through the web 812 in the widthwise direction and elongated along the circumferential direction. The boss 813 is formed in a cylindrical shape extending rightward from an inner peripheral edge of the web 812.

Second Sector Gear

The second sector gear 82 is arranged in an orientation such that a direction of a rotation axis thereof aligns with the widthwise direction and is rotatable counterclockwise in the view from the right. The second sector gear 82 includes a rim 821, a web 822, and a boss 823.

The rim 821 is formed in a short cylindrical shape. On an outer circumferential surface of the rim 821, second teeth portions 824A, 824B, 824C, each including a plurality of gear teeth, are formed. The second teeth portion 824A, the second teeth portion 824B, and the second teeth portion 824C are arranged along a circumferential direction of the rim 821 in the given order from upstream to downstream in the rotating direction of the second sector gear 82.

Among the second teeth portions 824A, 824B, 824C, second toothless portions 825A, 825B, 825C are formed. In particular, between the second teeth portion 824C and the second teeth portion 824A, a second toothless portion 825A, which lacks gear teeth, is formed; between the second teeth portion 824A and the second teeth portion 824B, a second toothless portion 825B, which lacks gear teeth, is formed; and between the second teeth portion 824B and the second teeth portion 824C, a second toothless portion 825C, which lacks gear teeth, is formed.

The web 822 is formed in a substantially annular shape extending from an inner peripheral surface of the rim 821 toward a center of the second sector gear 82. In a central area in a radial direction of the web 822, at a position coincident with the elongated hole 819 in the first sector gear 81, a protrusion 856 protruding rightward is formed. The protrusion 826 is inserted in the elongated hole 819 from the left. In the rotating direction of the second sector gear 82, a length of the protrusion 826 is smaller than a length of the elongated hole 819. The protrusion 826 is movable in the circumferential direction within a range of the length of the elongated hole 819.

The boss 823 is formed in a cylindrical shape extending both leftward and rightward from an inner peripheral edge of the web 822. An outer diameter of the boss 823 is smaller than an inner diameter of the boss 813 of the first sector gear 81.

As shown in FIGS. 2 and 3, the second sector gear 82 includes a cam 827 located on a leftward side of the web 822. The cam 827 includes a first cam face 827*a*, a second cam face 827*b*, and a third cam face 827*c*.

The first cam face 827*a* extends in the radial direction of the second sector gear 82. The second cam face 827*b* is connected with the first cam face 827*a* at one end thereof and extends at an acute angle with respect to the first cam face 827*a*. The third cam face 827*c* is formed between the boss 823 and the other end of the second cam face 827*b* and extends in a direction intersecting orthogonally with the extending direction of the second cam face 827*b*.

The first sector gear 81 and the second sector gear 82 are engaged with each other with some play reserved therebetween. In particular, the rim 821 of the second sector gear 82 is located leftward from the rim 811 of the first sector gear 81, and the boss 823 of the second sector gear 82 is inserted in the boss 813 of the first sector gear 81 from the left. Moreover, the protrusion 826 of the second sector gear 82 is inserted in the elongated hole 819 in the first sector gear 81 from the left. The second sector gear 82 is rotatable relatively to the first sector gear 81 within the movable range of the protrusion 826 in the elongated hole 819.

In the state where the first sector gear 81 and the second sector gear 82 are engaged, the position of the first teeth portion 814A of the first sector gear 81 and the position of the second teeth portion 824A of the second sector gear 82 in the rotating direction substantially coincide with each other. Moreover, the position of the first toothless portion 815A of the first sector gear 81 and the position of the second toothless portion 825A of the second sector gear 82 in the rotating direction substantially coincide with each other, and the position of the first toothless portion 815B of the first sector gear 81 and the position of the second toothless portion 825B of the second sector gear 82 in the rotating direction substantially coincide with each other. Furthermore, the position of the first teeth portion 814B of the first sector gear 81 substantially coincides with the positions of the second teeth portion 824B, the second toothless portion 825C, and the second teeth portion 824C of the second sector gear 82 in the rotating direction.

Switch Arm

As shown in FIGS. 2 and 3, the switch arm 92 is formed of a bar member extending in a direction intersecting orthogonally with the widthwise direction. The switch arm 92 includes a first bearing 921, a second bearing 922, an opening 923, and a cam-contact face 924.

In the first bearing 921, a rotation shaft 71*a* of the driving gear 71 is inserted. By the rotation shaft 71*a* inserted in the first bearing 921, the switch arm 92 is pivotably supported.

In the second bearing 922, a rotation shaft 72*a* of the pendulum gear 72 is inserted. With the rotation shaft 72*a* inserted in the second bearing 922, the pendulum gear 72 is rotatably supported by the switch arm 92. The second bearing 922 is located to be higher than the first bearing 921.

By the switch arm 92 pivoting about the rotation shaft 71*a*, the pendulum gear 72 is movable between the third position, at which the pendulum gear 72 meshes with the first intermediate input gear 73, and the fourth position, at which the pendulum gear 72 meshes with the second intermediate input gear 74.

The opening 923 is formed through the switch arm 92 in the widthwise direction. The cam-contact face 924 is formed on a peripheral edge of the opening 923, and the cam 827 of the second sector gear 82 may be in contact therewith. The cam-contact face 924 is located frontward with respect to the first bearing 921.

The cam-contact face 924 is formed on a lower peripheral edge of the opening 923 and includes a first contact face 924*a*, a second contact face 924*b*, and a third contact face 924*c*. The first contact face 924*a* is located on a frontward end of the cam-contact face 924, the third contact face 924*c* is located rearward with respect to the first contact face 924*a*, and the second contact face 924*b* is located between the first contact face 924*a* and the third contact face 924*c*.

Lever

As shown in FIGS. 2-4 and 6, the lever 93 includes a boss 931, a first engageable claw 932, a second engageable claw 933, an operating portion 934, and a connecting wall 935.

The boss 931 is formed in a cylindrical shape extending along the widthwise direction. The gear frame 91 includes a supporting shaft 912 extending along the widthwise direction. The supporting shaft 912 extends leftward from the supporting wall 911. The supporting shaft 912 is inserted in the boss 931 of the lever 93. The boss 931 is pivotably supported by the supporting shaft 912. The lever 93 is pivotable about the supporting shaft 912. The gear frame 91 is an example of the frame including the supporting shaft to be inserted in the boss of the lever.

The first engageable claw 932 protrudes outward from the boss 931 in a radial direction. The first engageable claw 932 is engageable with the engageable portion 817 of the first sector gear 81. The radial direction is an example of the direction intersecting orthogonally with the axial direction of the conveyer roller.

The second engageable claw 933 protrudes outward from the boss 931 in the radial direction in a phase different from the protruding direction of the first engageable claw 932. The second engageable claw 933 is engageable with the engageable portion 817 of the first sector gear 81. The first engageable claw 932 and the second engageable claw 933 are examples of the engageable claw engageable with the engageable portion of the sector gear.

The operating portion 934 protrudes outward from the boss 931 in a radial direction in a phase different from the protruding directions of the first engageable claw 932 and the second engageable claw 933. The operating portion 934 is engageable with the solenoid 94.

The operating portion 934 protrudes obliquely upper-rearward from the boss 931, the first engageable claw 932 protrudes obliquely lower-rearward from the boss 931, and the second engageable claw 933 protrudes substantially downward from the boss 931. The operating portion 934 and the first engageable claw 932 are arranged adjacent to each other.

The connecting wall 935 is a wall member formed between the operating portion 934 and the first engageable claw 932. The connecting wall 935 connects the operating portion 934 and the first engageable claw 932. The boss 931 and the operating portion 934 protrude leftward with respect to the first engageable claw 932 and the second engageable claw 933.

The lever 93 is movable between a first position (see FIG. 8) and a second position (FIG. 7) by a pulling effect of the solenoid 94 acting on the operating portion 934. In particular, by being pulled by the solenoid 94 engaged with the operating portion 934, the lever 93 may pivot about the supporting shaft 912 and move to the first position, and by being released from the pulling effect of the solenoid 94, the lever 93 may pivot about the supporting shaft 912 and move to the second position.

When the lever 93 is at the first position, the second engageable claw 933 is located within a range, in which the engageable portion 817 may move along with the rotation of the first sector gear 81, and the first engageable claw 932 is located outside the range, in which the engageable portion 817 may move along with the rotation of the first sector gear 81.

When the lever 93 is at the second position, the first engageable claw 932 is located in the range, in which the engageable portion 817 may move along with the rotation of the first sector gear 81, and the second engageable claw 933 is located outside the range, in which the engageable portion 817 may move along with the rotation of the first sector gear 81.

Solenoid

As shown in FIGS. 2-4, the solenoid 94 includes a plunger 941, a coil 942, a case 943, and an urging spring 944.

The plunger 941 is movable in a pulling direction, in which the solenoid 94 may pull the operating portion 934 of the lever 93. The plunger 941 includes an engageable portion 941*a* engageable with the operating portion 934 of the lever 93. The operating portion 934 of the lever 93 includes a solenoid-contact portion 934*a* (see FIG. 6) that may contact the engageable portion 941*a* of the plunger 941 when the engageable portion 941*a* and the operating portion 934 are engaged. The solenoid-contact portion 934*a* protrudes outward in the radial direction from the boss 931.

In the coil 942, the solenoid 94 is inserted movably. When the solenoid 94 is turned on and the current flows through the coil 942, the plunger 941 is drawn inside the coil 942 and pulls the operating portion 934 of the lever. By the operating portion 934 being pulled by the plunger 941, the lever 93 moves to the first position.

When the solenoid 94 is turned off and the current stops, the plunger 941 is drawn outside from the coil 942, and the operating portion 934 of the lever 93 is released from the pulling effect of the plunger 941. As the operating portion 934 is released from the pulling effect, the lever 93 moves to the second position.

The case 943 covers the coil 942. The urging spring 944 is a coil spring and is located between the case 943 of the solenoid 94 and the operating portion 934 of the lever 93.

The urging spring 944 urges the lever 93 from a side of the first position toward a side of the second position. The lever 93 is moved by an urging force of the urging spring 944 from the first position to the second position when the operating portion 934 is released from the pulling effect of the plunger 941.

Urging Members

As shown in FIGS. 2-4, the driving device 7 includes a first urging member 83, a second urging member 84, and a third urging member 85.

The first urging member 83 is a coil spring. The first urging member 83 is connected to the first sector gear 81 at one end thereof and with the second sector gear 82 at the other end thereof. The first sector gear 81 is urged by the first urging member 83 in the clockwise direction in a view from the left. The first sector gear 81 is rotatable by the urging force of the first urging member 83 with respect to the second sector gear 82 in the clockwise direction in the view from the left.

Figure 11:
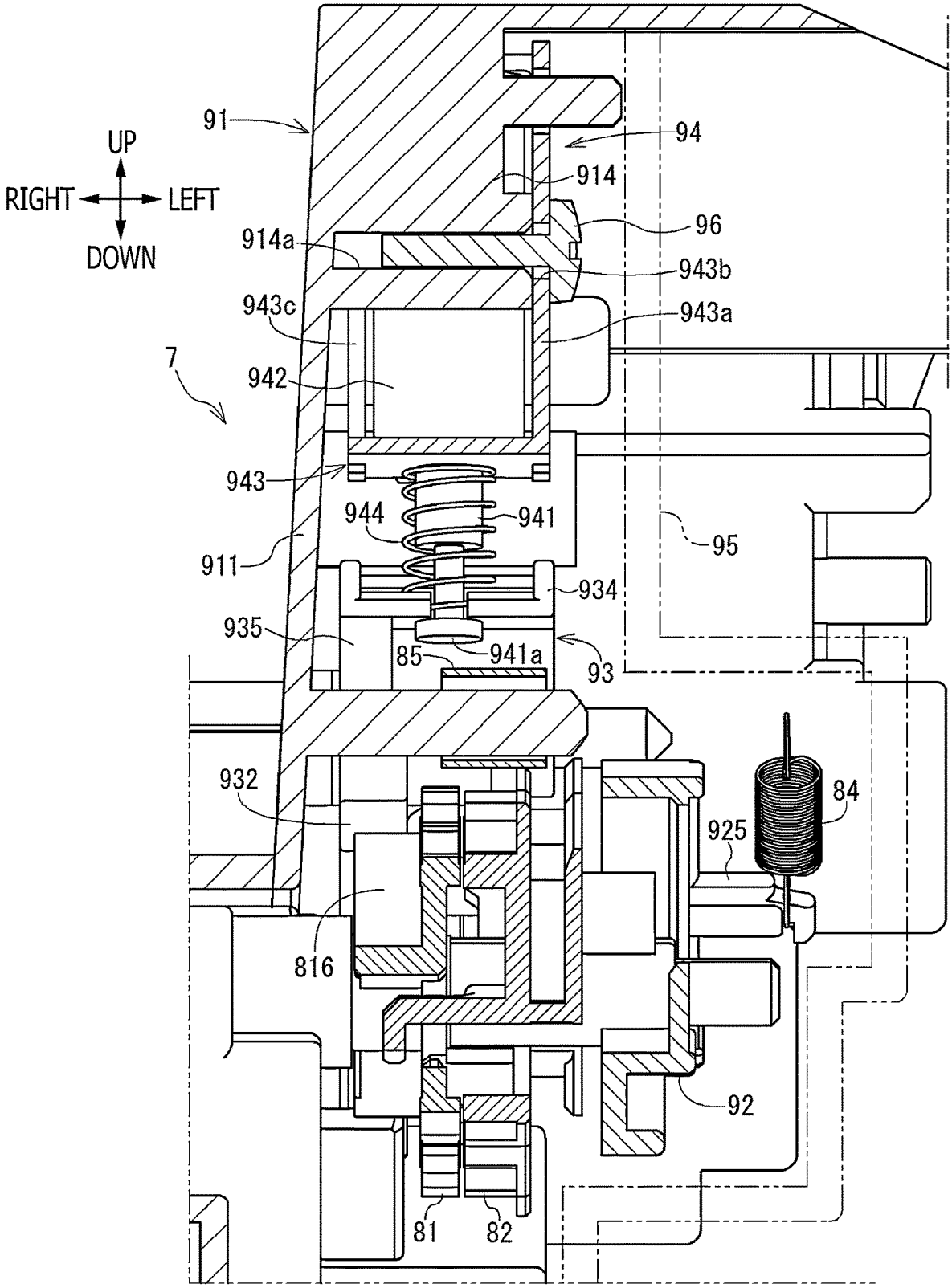
FIG. 11 is a cross-sectional rearward view of the solenoid and a solenoid-fixing portion in the driving device.

The second urging member 84 is a coil spring. The driving device 7 includes a gear cover 95 (see FIG. 11) to cover the gears 70-79, the switch arm 92, the lever 93, and the solenoid 94 from the left. The gear cover 95 covers the switch arm 92 from a side opposite across the switch arm 92 to the supporting wall 911 of the gear frame 91 in the widthwise direction. The switch arm 92 includes a spring supporting portion 925 located frontward with respect to the first bearing 921.

The second urging member 84 is connected to the spring supporting portion 925 of the switch arm 92 at one end thereof and to the gear cover 95 at the other end thereof. By the second urging member 84, a part of the switch arm 92 frontward with respect to the first bearing 921 is urged upward.

The third urging member 85 is a torsion spring. The gear frame 91 includes a spring engageable portion 913. The third urging member 85 is engaged with the spring engageable portion 913 of the gear frame 91 at one end thereof and is in contact with the second sector gear 82 at the other end thereof. By the third urging member 85, the second sector gear 82 is urged in the clockwise direction in the view from the left.

Behaviors of Driving Device

According to the above-described configuration, the rotating mode of the sheet-ejection roller 64*a* and the intermediate sheet-ejection roller 63*a* may be switched between a forward rotation mode, in which the sheet-ejection roller 64*a* and the intermediate sheet-ejection roller 63*a* rotate in the forward direction, and a reverse rotation mode, in which the sheet-ejection roller 64*a* and the intermediate sheet-ejection roller 63*a* rotate in the reverse direction.

Forward Rotation Mode

Figure 7A:
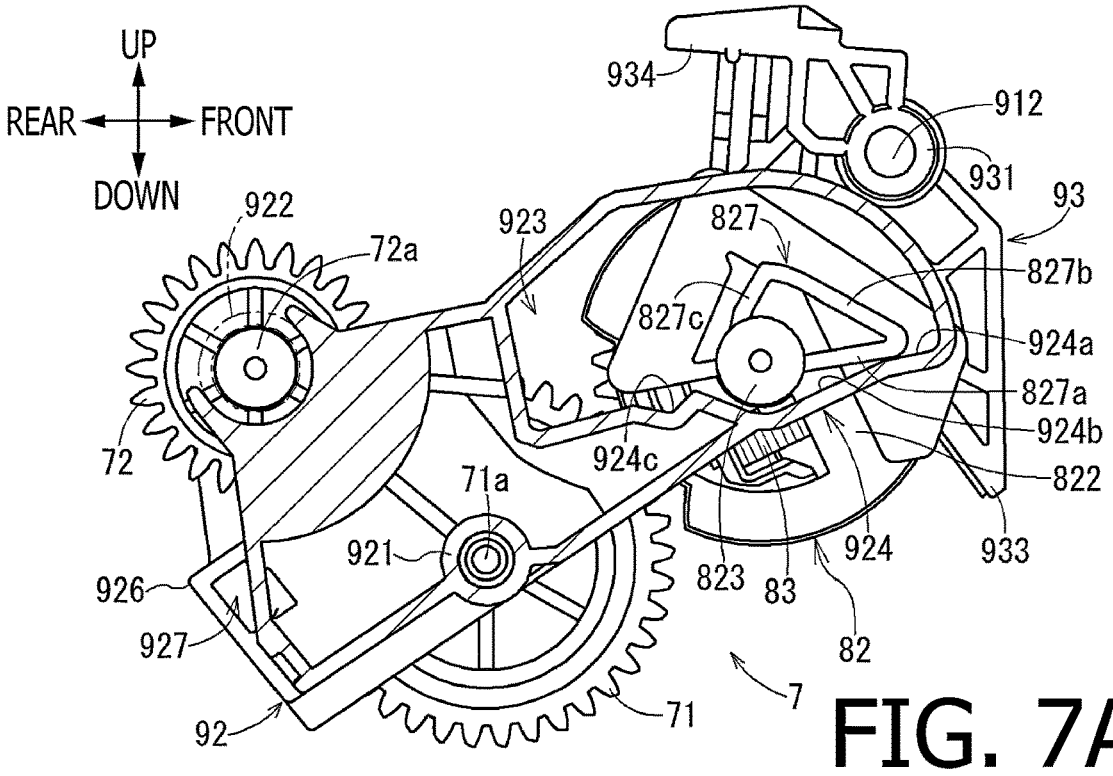
FIG. 7A is a leftward side view of a part of the driving device in a forward-rotating mode.
Figure 7B:
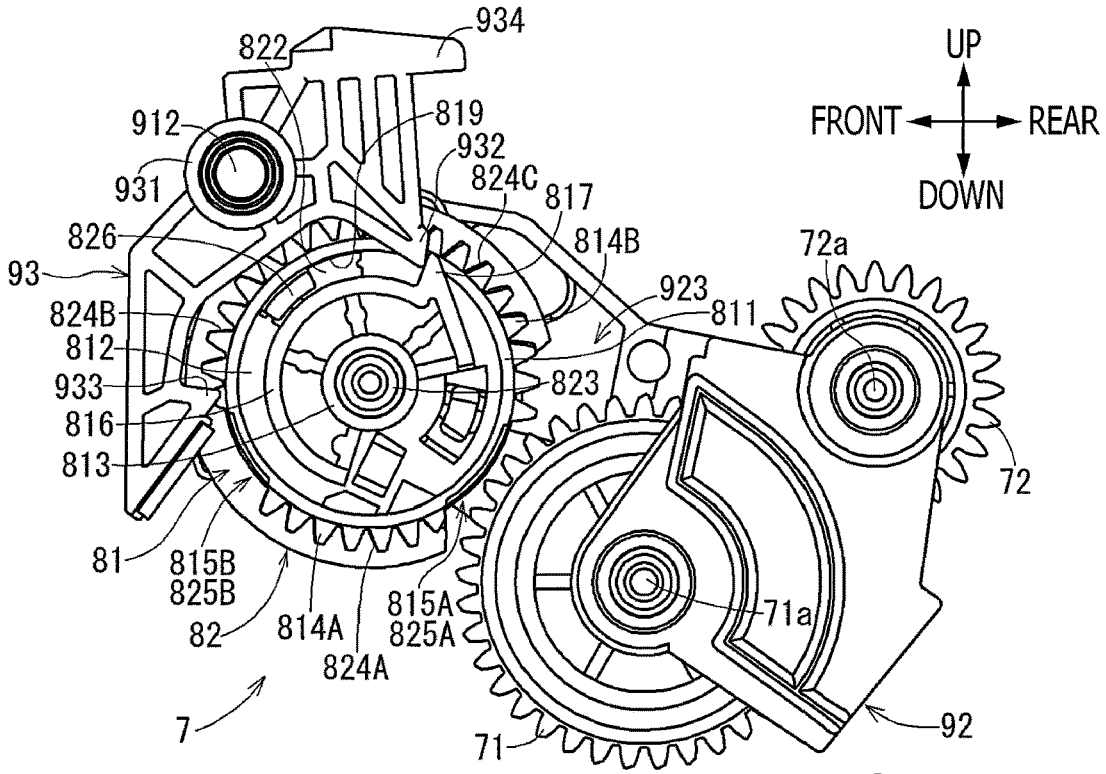
FIG. 7B is a rightward side view of the part of the driving device in the forward-rotating mode.

In the state where the driving device 7 is in the forward rotation mode, as shown in FIGS. 7A-7B, the first cam face 827*a* of the cam 827 in the second sector gear 82 is in contact with the first contact face 924*a* of the cam-contact face 924 of the switch arm 92.

In this state, the switch arm 92 is in a posture such that the switch arm 92 is pivoted about the rotation shaft 71*a* of the driving gear 71 by the urging force of the second urging member 84, and the frontward part thereof is lifted to a highest position thereof. In this state, the pendulum gear 72 is located at the third position and meshes with the first intermediate input gear 73.

Accordingly, the driving force input from the input gear 70 to the driving gear 71 is transmitted through the pendulum gear 72, the first intermediate input gear 73, the first idle gear 75, the second idle gear 76, the third idle gear 77, and the sheet-ejection roller gear 78 to the sheet-ejection roller 64*a*. The sheet-ejection roller 64*a*, to which the driving force is transmitted, rotates in the forward direction.

Moreover, the driving force input from the input gear 70 to the driving gear 71 is transmitted through the pendulum gear 72, the first intermediate input gear 73, and the intermediate sheet-ejection roller gear 79 to the intermediate sheet-ejection roller 63*a*. The intermediate sheet-ejection roller 63*a*, to which the driving force is transmitted, rotates in the forward direction.

In the forward rotation mode, the solenoid 94 is turned off, and the lever 93 is located at the second position where the lever 93 is released from the pulling effect of the solenoid 94. As shown in FIG. 7B, the first engageable claw 932 of the lever 93 located at the second position and the engageable portion 817 of the first sector gear 81 are engaged, and the first sector gear 81 is restricted from rotating counterclockwise in the view from the right.

By restricting rotation of the first sector gear 81, the second sector gear 82 is enabled to rotate within the range, in which the protrusion 826 is movable in the elongated hole 819 in the first sector gear 81.

The second sector gear 82 is urged by the third urging member 85 in the counterclockwise direction in the view from the right. By the second sector gear 82 being urged by the third urging member 85, the first urging member 83 is compressed. The first sector gear 81 is urged in the counterclockwise direction in the view from the right by an urging force of the first urging member 83 being compressed. By the urging force from the first sector gear 81, the engageable portion 817 and the first engageable claw 932 are maintained engaged.

In the state where the engageable portion 817 is engaged with the first engageable claw 932, the first toothless portion 815A of the first sector gear 81 and the second toothless portion 825A of the second sector gear 82 are located at position to face the driving gear 71, and the first sector gear 81 and the second sector gear 82 are not meshed with the driving gear 71. In this arrangement, the second sector gear 82 does not mesh with the driving gear 71 even if the second sector gear 82 rotates within the movable range.

Switching from Forward Rotation Mode to Reverse Rotation Mode

Figure 8A:
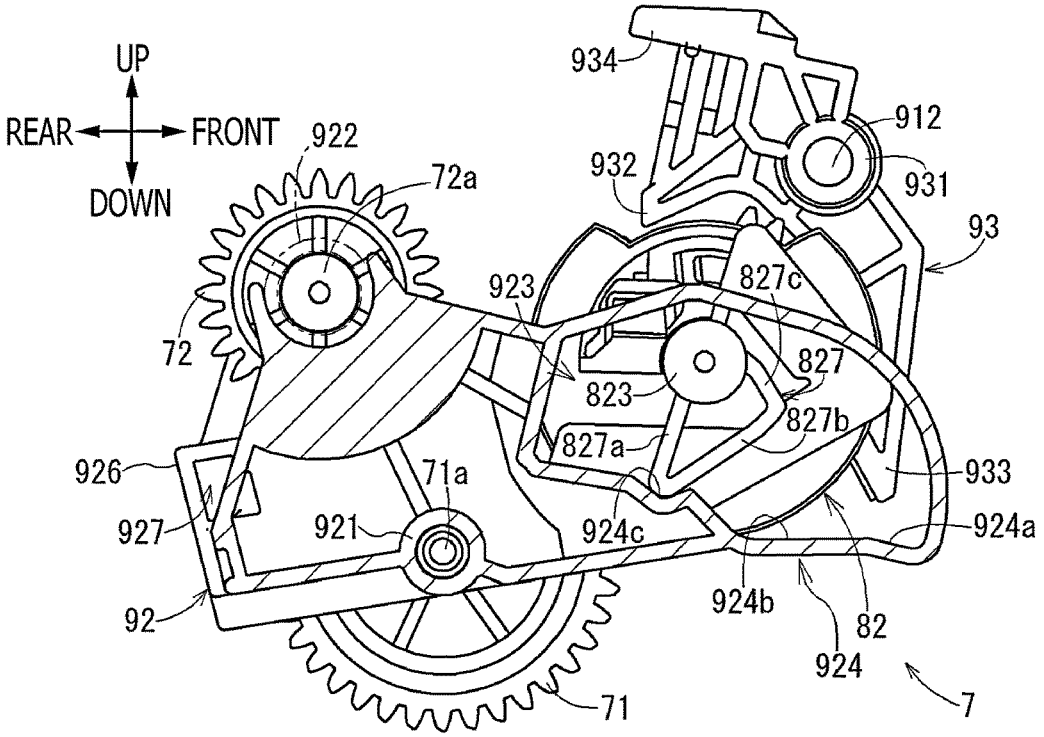
FIG. 8A is a leftward side view of the part of the driving device in a reverse-rotating mode.
Figure 8B:
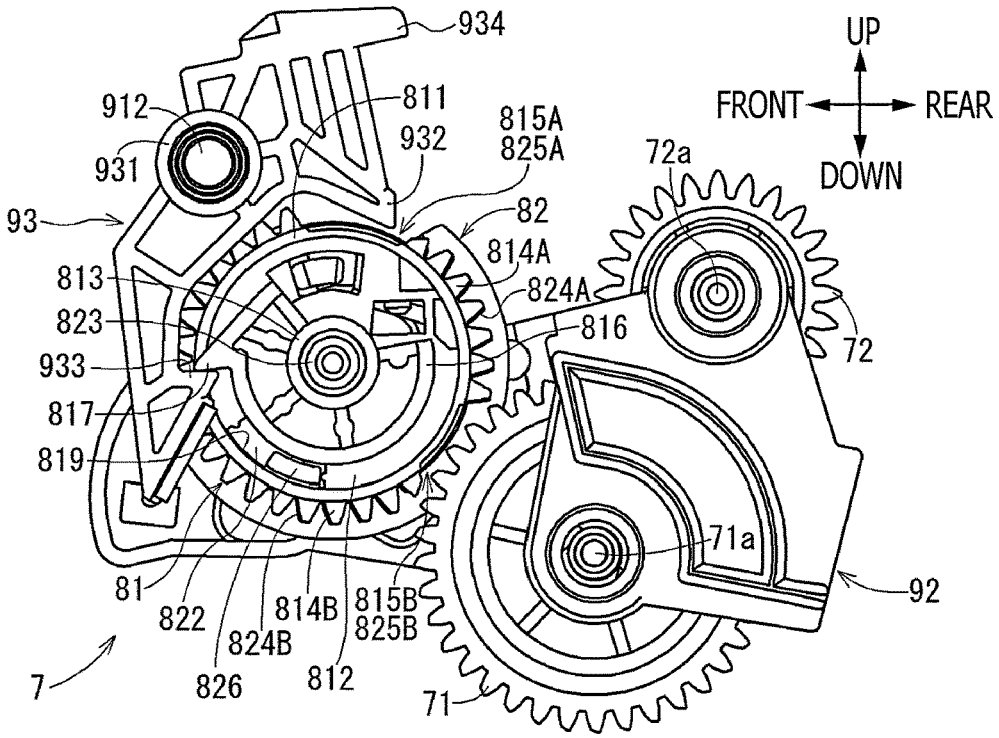
FIG. 8B is a rightward side view of the part of the driving device in the reverse-rotating mode.

For switching the rotation mode of the driving device 7 from the forward rotation mode to the reverse rotation mode, the solenoid 94 is switched from off to on. When the solenoid 94 is switched on, as shown in FIGS. 8A-8B, the operating portion 934 of the lever 93 is pulled by the solenoid 94, and the lever 93 moves from the second position to the first position. As the lever 93 moves to the first position, the engageable portion 817 of the first sector gear 81 is disengaged from the first engageable claw 932, and the first sector gear 81 is enabled to rotate.

The first sector gear 81 enabled to rotate is rotated by the urging force of the first urging member 83 counterclockwise in the view from the right. As the first sector gear 81 rotates by the urging force of the first urging member 83, the first teeth portion 814A of the first sector gear 81 moves to mesh with the driving gear 71. Once the first teeth portion 814A is meshed with the driving gear 71, the first sector gear 81 is rotatable by the driving force from the driving gear 71.

Moreover, as the first sector gear 81 rotates, an edge of the elongated hole 819 in the first sector gear 81 contacts the protrusion 826 of the second sector gear 82 and presses the protrusion 826 in the rotating direction of the first sector gear 81. By this pressing force and the urging force of the third urging member 85, the second sector gear 82 is rotated clockwise in a view from the left.

As the second sector gear 82 rotates, the second teeth portion 824A of the second sector gear 82 moves to mesh with the driving gear 71. Once the second teeth portion 824A is meshed with the driving gear 71, the second sector gear 82 is rotatable by the driving force from the driving gear 71.

As the second sector gear 82 rotates, the cam 827 pivots clockwise in the view from the left. As the cam 827 pivots, the state of contact between the cam 827 and the cam-contact face 924 of the switch arm 92 changes.

In particular, as the cam 827 pivots, the state of contact between the cam 827 and the cam-contact face 924 of the switch arm 92 shifts from the state, as shown in FIG. 7A, in which the first cam face 827*a* of the cam 827 is in contact with the first contact face 924*a* of the cam-contact face 924, to a state, in which an intermediate part between the first cam face 827*a* and the second cam face 827*b* of the cam 827 is in contact with the second contact face 924*b* of the cam-contact face 924.

As the cam 827 pivots further, as shown in FIG. 8A, the state of contact shifts to a state, in which the intermediate part between the first cam face 827*a* and the second cam face 827*b* is in contact with the third contact face 924*c* of the cam-contact face 924.

As the state of contact shifts, the cam-contact face 924 is pressed downward by the cam 827. As the cam-contact face 924 is lowered, the switch arm 92 pivots about the rotation shaft 71*a* of the driving gear 71 clockwise in the view from the left with the frontward part of the switch arm 92 moving downward.

As the switch arm 92 pivots, the pendulum gear 72 moves from the third position to the fourth position, and the pendulum gear 72 is disengaged from the first intermediate input gear 73 and meshes with the second intermediate input gear 74.

In this arrangement, as the first sector gear 81 and the second sector gear 82 are rotated by the driving force from the driving gear 71, as shown in FIG. 8B, the first toothless portion 815B of the first sector gear 81 and the second toothless portion 825B of the second sector gear 82 move to the position to face the driving gear 71. Therefore, the first sector gear 81 and the second sector gear 82 are disengaged from the driving gear 71.

As the first sector gear 81 and the second sector gear 82 are disengaged from the driving gear 71, the driving force from the driving gear 71 is no longer input to the first sector gear 81 or the second sector gear 82.

The first sector gear 81 and the second sector gear 82 without the input of the driving force from the driving gear 71 rotate by the urging force of the third urging member 85 and stop rotating as the engageable portion 817 of the first sector gear 81 engages with the second engageable claw 933 of the lever 93. In the state where the first sector gear 81 and the second sector gear 82 are stopped, the position of the first toothless portion 815B and the second toothless portion 825B facing the driving gear 71 is maintained.

While the engageable portion 817 and the second engageable claw 933 are engaged, the first urging member 83 is compressed by the urging force of the third urging member 85. Accordingly, by the urging force of the first urging member 83, the engageable portion 817 and the second engageable claw 933 are maintained engaged.

As the engageable portion 817 engages with the second engageable claw 933, the state of contact between the cam 827 and the cam-contact face 924 shifts to a state, in which the intermediate part between the first cam face 827*a* and the second cam face 827*b* is in contact with the third contact face 924*c* of the cam-contact face 924, and the pendulum gear 72 moves to the fourth position. The pendulum gear 72 moved to the fourth position meshes with the second intermediate input gear 74, and switching of the rotation mode from the forward rotation mode to the reverse rotation mode is completed.

In the reverse rotation mode, the driving force input from the input gear 70 to the driving gear 71 is transmitted through the pendulum gear 72, the second intermediate input gear 74, the second idle gear 76, the third idle gear 77, and the sheet-ejection roller gear 78 to the sheet-ejection roller 64*a*, and the sheet-ejection roller 64*a* rotates in the reverse direction.

Moreover, the driving force input from the input gear 70 to the driving gear 71 is transmitted through the pendulum gear 72, the second intermediate input gear 74, the second idle gear 76, the first idle gear 75, the first intermediate input gear 73, and the intermediate sheet-ejection roller gear 79 to the intermediate sheet-ejection roller 63*a*, and the intermediate sheet-ejection roller 63*a* rotates in the reverse direction.

Switching from Reverse Rotation Mode to Forward Rotation Mode

For switching the rotation mode of the driving device 7 from the reverse rotation mode to the forward rotation mode, the solenoid 94 is switched from on to off. When the solenoid 94 is switched off, as shown in FIGS. 7A-7B, the operating portion 934 of the lever 93 is released from the pulling effect of the solenoid 94, and the lever 93 moves from the first position to the second position due to the urging force of the urging spring 944.

As the lever 93 moves to the second position, the engageable portion 817 of the first sector gear 81 is disengaged from the first engageable claw 932 of the lever 93, and the first sector gear 81 is enabled to rotate.

The first sector gear 81 enabled to rotate is rotated by the urging force of the first urging member 83 counterclockwise in the view from the right. As the first sector gear 81 rotates by the urging force of the first urging member 83, the first teeth portion 814B of the first sector gear 81 moves to mesh with the driving gear 71. Once the first teeth portion 814B is meshed with the driving gear 71, the first sector gear 81 is rotatable by the driving force from the driving gear 71.

Moreover, as the first sector gear 81 rotates, the edge of the elongated hole 819 in the first sector gear 81 contacts the protrusion 826 of the second sector gear 82 and presses the protrusion 826 in the rotating direction of the first sector gear 81. By this pressing force and the urging force of the third urging member 85, the second sector gear 82 is rotated clockwise in the view from the left.

As the second sector gear 82 rotates, the second teeth portion 824B of the second sector gear 82 moves to mesh with the driving gear 71. Once the second teeth portion 824B is meshed with the driving gear 71, the second sector gear 82 is rotatable by the driving force from the driving gear 71.

As the second sector gear 82 rotates, the cam 827 pivots clockwise in the view from the left. As the cam 827 pivots, the state of contact between the cam 827 and the cam-contact face 924 of the switch arm 92 changes.

In particular, as the cam 827 pivots, the state of contact between the cam 827 and the cam-contact face 924 of the switch arm 92 shifts from the state, as shown in FIG. 8A, in which the intermediate part between the first cam face 827*a* and the second cam face 827*b* of the cam 827 is in contact with the third contact face 924*c* of the cam-contact face 924, to a state, in which the intermediate part between the first cam face 827*a* and the second cam face 827*b* separates from the third contact face 924*c*.

Thereafter, the state of contact shifts, through a state, in which an intermediate part between the second cam face 827*b* and the third cam face 827*c* of the cam 827 is in contact with the third contact face 924*c* of the cam-contact face 924, to the state, as shown in FIG. 7A, in which the first cam face 827*a* of the cam 827 is in contact with the first contact face 924*a* of the cam-contact face 924.

As the state of contact shifts, the switch arm 92 pivots about the rotation shaft 71*a* of the driving gear 71 counter-clockwise in the view from the left with the frontward part of the switch arm 92 moving upward.

As the switch arm 92 pivots, the pendulum gear 72 moves from the fourth position to the third position, and the pendulum gear 72 is disengaged from the second intermediate input gear 74 and meshes with the first intermediate input gear 73.

In this arrangement, as the first sector gear 81 and the second sector gear 82 are rotated by the driving force from the driving gear 71, as shown in FIG. 7B, the first toothless portion 815A of the first sector gear 81 and the second toothless portion 825A of the second sector gear 82 move to the position to face the driving gear 71. Therefore, the first sector gear 81 and the second sector gear 82 are disengaged from the driving gear 71.

As the first sector gear 81 and the second sector gear 82 are disengaged from the driving gear 71, the driving force from the driving gear 71 is no longer input to the first sector gear 81 or the second sector gear 82.

The first sector gear 81 and the second sector gear 82 without the input of the driving force from the driving gear 71 rotate by the urging force of the third urging member 85 and stop rotating as the engageable portion 817 of the first sector gear 81 engages with the first engageable claw 932 of the lever 93. In the state where the first sector gear 81 and the second sector gear 82 are stopped, the position of the first toothless portion 815A and the second toothless portion 825A facing the driving gear 71 is maintained.

While the engageable portion 817 and the first engageable claw 932 are engaged, the first urging member 83 is compressed by the urging force of the third urging member 85. Accordingly, by the urging force of the first urging member 83, the engageable portion 817 and the first engageable claw 932 are maintained engaged.

As the engageable portion 817 engages with the first engageable claw 932, the state of contact between the cam 827 and the cam-contact face 924 shifts to a state, in which the first cam face 827*a* of the cam 827 is in contact with the first contact face 924*a* of the cam-contact face 924, and the pendulum gear 72 moves to the third position. The pendulum gear 72 moved to the third position meshes with the first intermediate input gear 73, and switching of the rotation mode from the reverse rotation mode to the forward mode is completed.

As such, in the driving device 7, in conjunction with the lever 93 moving between the first position and the second position, the pendulum gear 72 is movable between the third position, at which the pendulum gear 72 meshes with the first intermediate input gear 73, and the fourth position, at which the pendulum gear 72 is disengaged from the first intermediate input gear 73. Meanwhile, the switch arm 92 that supports the pendulum gear 72 may, in conjunction with the lever 93 moving between the first position and the second position, move the pendulum gear 72 between the third position and the third position.

Supporting Structure of Lever

Figure 9:
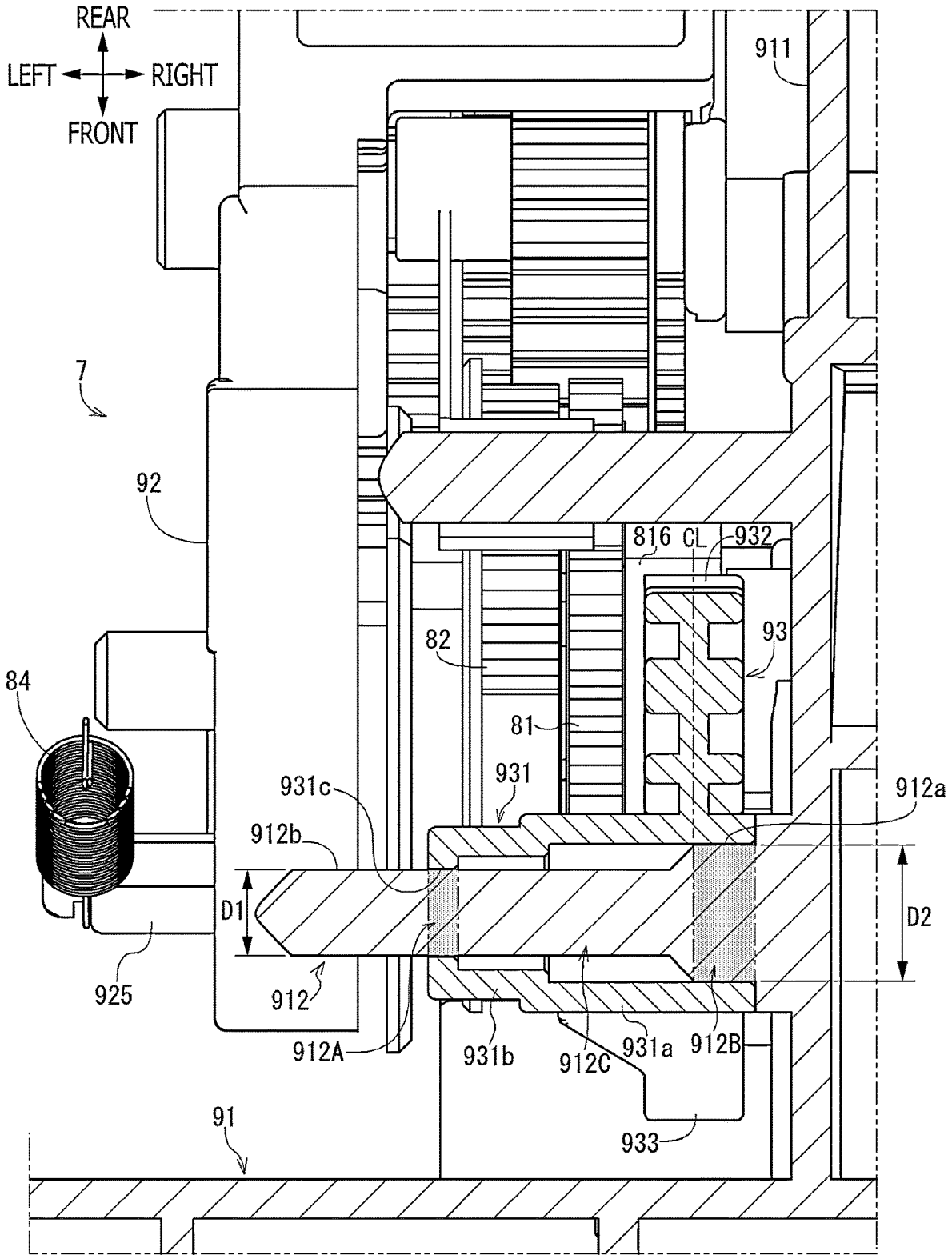
FIG. 9 is a cross-sectional view of a supporting shaft and the lever in the driving device.

As shown in FIG. 9, by the supporting shaft 912 of the gear frame 91 being inserted in the boss 931, the lever 93 is pivotably supported by the gear frame 91.

The boss 931 includes a larger-diameter portion 931*a*, an intermediate portion 931*b*, and a smaller-diameter portion 931*c*. The larger-diameter portion 931*a* is located rightward in the boss 931, and the smaller-diameter portion 931*c* is located leftward in the boss 931. The intermediate portion 931*b* is located between the larger-diameter portion 931*a* and the smaller-diameter portion 931*c* in the widthwise direction. The intermediate portion 931*b* is formed to have a diameter smaller than the larger-diameter portion 931*a*, and the smaller-diameter portion 931*c* is formed to have a diameter smaller than the intermediate portion 931*b*.

The supporting shaft 912 includes a larger-diameter portion 912*a* and a smaller-diameter portion 912*b*. The larger-diameter portion 912*a* is located on a rightward end in the supporting shaft 912, which is a basal end closer to the supporting wall 911 of the gear frame 91, and the smaller-diameter portion 912*b* extends leftward from the larger-diameter portion 912*a*. The larger-diameter portion 912*a* is formed to have a larger diameter than the smaller-diameter portion 912*b*.

In the state where the supporting shaft 912 is inserted in the boss 931, the larger-diameter portion 912*a* of the supporting shaft 912 is in contact with a rightward end of the larger-diameter portion 931*a* of the boss 931, and a midst part of the smaller-diameter portion 912*b* in the widthwise direction is in contact with the smaller-diameter portion 931*c* of the boss 931. A part of the supporting shaft 912 between the part, at which the supporting shaft 912 contacts the larger-diameter portion 931*a* of the boss 931, and the part, at which the supporting shaft 912 contacts the smaller-diameter portion 931*c* of the boss 931, is not in contact with an inner circumferential surface of the boss 931 but is separated from the inner circumferential surface of the boss 931.

The part of the supporting shaft 912 that contacts the smaller-diameter portion 931*c* of the boss 931 forms a first contact portion 912A, and the part of the supporting shaft 912 that contacts the larger-diameter portion 931*a* of the boss 931 forms a second contact portion 912B. The first contact portion 912A and the second contact portion 912B are located apart in the widthwise direction. The part of the supporting shaft 912 between the first contact portion 912A and the second contact portion 912B forms a separated portion 912C, which is spaced from the inner circumferential surface of the boss 931. In other words, the supporting shaft 912 supports the boss 931 of the lever 93 by the first contact portion 912A and the second contact portion 912B, which are apart in the widthwise direction.

As such, in the driving device 7, the boss 931 of the lever 93 is supported by the supporting shaft 912 at the two portions, i.e., the first contact portion 912A and the second contact portion 912B, which are on one side and the other side of the separated portion 912C in the supporting shaft 912. Therefore, compared to a structure, in which the supporting shaft 912 supports the boss 931 of the lever 93 on an entire outer circumferential surface thereof, a frictional force that may be produced between the lever 93 and the supporting shaft 912 may be reduced. Accordingly, even in the case where the lever 93 is moved with use of the downsized solenoid 94, of which attractive force is smaller, the lever 93 may be moved 93 smoothly.

Moreover, the lever 93 is supported by the supporting shaft 912, which is a single part of the gear frame 91. Therefore, compared to a structure, in which the lever 93 is supported by two or more combined parts, positional accuracy of the part that supports the lever 93 with respect to the lever 93 may be improved. Accordingly, misalignment between the lever 93 and the part that supports the lever 93 may be prevented, and thereby deformation of the lever 93 when operating may be reduced, and the lever 93 may be moved smoothly.

Moreover, the first contact portion 912A of the supporting shaft 912 is located closer than the second contact portion 912B to a tip end of the supporting shaft 912. The second contact portion 912B is formed to have a diameter D2 larger than a diameter D1 of the first contact portion 912A. Therefore, when the lever 93 and the supporting shaft 912 are coupled to each other by inserting the tip end of the supporting shaft 912 into the boss 931, stability and of the lever 93 to the supporting shaft 912 may be improved.

Moreover, the gear frame 91, in which the supporting shaft 912 supporting the lever 93 is formed, serves as a gear cover to cover the gears 70-79. Therefore, the driving device 7 does not require a cover to cover the gears 70-79 separately from the gear frame 91, which is essential, and a quantity of the parts in the driving device 7 may be reduced.

Positional Relation among Engageable Claw of Lever, Solenoid-Contact Portion, and Lever As shown in FIG. 4, the first engageable claw 932 of the lever 93 is engageable with the engageable portion 817 formed in the engageable wall 816 of the first sector gear 81. In the state where the first engageable claw 932 is engaged with the engageable portion 817, a force in the rotating direction from the engageable portion 817 of the first sector gear 81 acts on the first engageable claw 932. When the force from the first sector gear 81 is acting on the first engageable claw 932, the supporting shaft 912 supporting the lever 93 is affected by the force as well.

Figure 10:
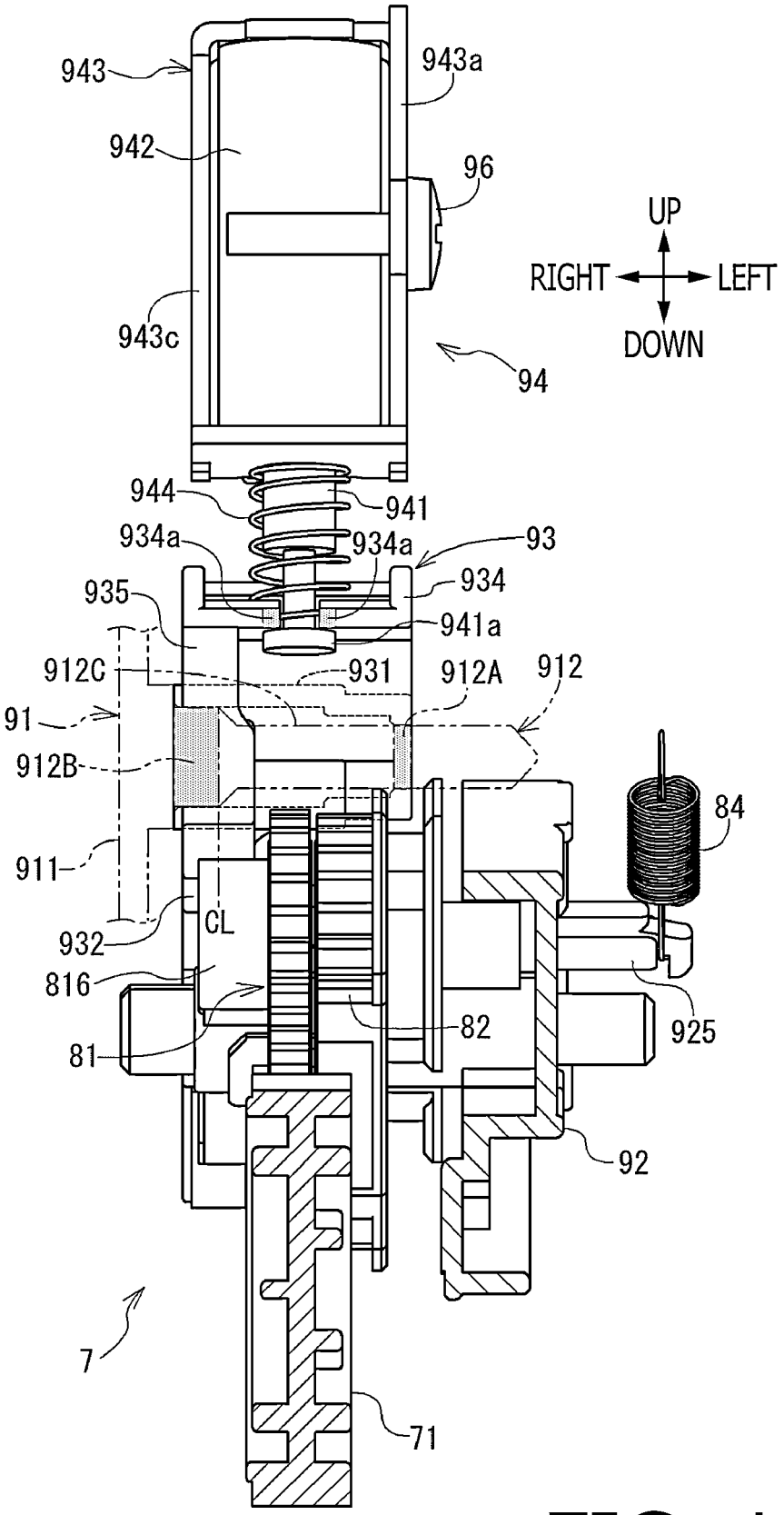
FIG. 10 is a cross-sectional rearward view of the driving device.

As shown in FIGS. 9 and 10, a center line CL at a center of the first engageable claw 932 in the widthwise direction is located on a leftward end of the second contact portion 912B of the supporting shaft 912. Therefore, a leftward half of the first engageable claw 932 is located between the first contact portion 912A and the second contact portion 912B in the widthwise direction, and the first engageable claw 932 includes a portion located between the first contact portion 912A and the second contact portion 912B in the widthwise direction.

As such, the first engageable claw 932 is located partly between the first contact portion 912A and the second contact portion 912B in the widthwise direction. Therefore, when the force acting on the first engageable claw 932 is conveyed to the supporting shaft 912, the supporting shaft 912 may prevent the force from acting unevenly on either one of the first contact portion 912A or the second contact portion 912B. Accordingly, even in the case where the lever 93 is configured to be moved with use of the downsized solenoid 94, of which attractive force is smaller, the lever 93 may be moved 93 smoothly.

The second engageable claw 933 of the lever 93, similarly to the first engageable claw 932, is located between the first contact portion 912A and the second contact portion 912B in the widthwise direction. Therefore, when the force acting on the second engageable claw 933 is conveyed to the supporting shaft 912, the supporting shaft 912 may prevent the force from acting unevenly on either one of the first contact portion 912A or the second contact portion 912B. Accordingly, even in the case where the lever 93 is configured to be moved with use of the downsized solenoid 94, of which attractive force is smaller, the lever 93 may be moved 93 smoothly.

As shown in FIG. 10, the operating portion 934 of the lever 93 is engageable with the engageable portion 941*a* in the plunger 941 of the solenoid 94. In the state where the operating portion 934 is engaged with the engageable portion 941*a*, the engageable portion 941*a* contacts the operating portion 934 at the solenoid-contact portion 934*a*. As the operating portion 934 engaged with the engageable portion 941*a* is pulled by the plunger 941, the force in the pulling direction acts on the solenoid-contact portion 934*a* of the operating portion 934.

When the force from the plunger 941 acts on the solenoid-contact portion 934*a*, the force acts on the supporting shaft 912 supporting the lever 93 as well. The solenoid-contact portion 934*a* of the operating portion 934 is located between the first contact portion 912A and the second contact portion 912B in the widthwise direction.

As such, the solenoid-contact portion 934*a* of the operating portion 934 is located between the first contact portion 912A and the second contact portion 912B in the widthwise direction. Therefore, when the force acting on the solenoid-contact portion 934*a* is conveyed to the supporting shaft 912, the supporting shaft 912 may prevent the force from acting unevenly on either one of the first contact portion 912A or the second contact portion 912B. Accordingly, even in the case where the lever 93 is configured to be moved with use of the downsized solenoid 94, of which attractive force is smaller, the lever 93 may be moved 93 smoothly.

While the solenoid-contact portion 934*a* is located leftward with respect to the first engageable claw 932 and the second engageable claw 933, the solenoid-contact portion 934*a*, the first engageable claw 932, and the second engageable claw 933 are all located between the first contact portion 912A and the second contact portion 912B.

Therefore, in a case where the force acts on the solenoid-contact portion 934*a*, the first engageable claw 932, and the second engageable claw 933, the supporting shaft 912 may prevent the force from acting unevenly on either one of the first contact portion 912A or the second contact portion 912B. Accordingly, even in the case where the lever 93 is configured to be moved with use of the downsized solenoid 94, of which attractive force is smaller, the lever 93 may be moved 93 smoothly.

Connecting Wall of the Lever

In the lever 93, when the force in the pulling direction from the solenoid 94 acts on the solenoid-contact portion 934*a* and the force in the rotating direction from the first sector gear 81 acts on the first engageable claw 932, the force in a direction to separate the operating portion 934 and the first engageable claw 932 from each other may act on the operating portion 934 and the first engageable claw 932.

Yet, the operating portion 934 and the first engageable claw 932 are connected through the connecting wall 935. Therefore, the operating portion 934 and the first engageable claw 932 are prevented from separating from each other. Accordingly, when the operating portion 934 pulled by the solenoid 94 moves to the first position, the first engageable claw 932 and the engageable portion 817 of the first sector gear 81 may be disengaged preferably.

Fixing Solenoid onto Gear Frame

As shown in FIGS. 2-4 and 11, the case 943 of the solenoid 94 includes a case lateral surface 943*a*. The case lateral surface 943*a* is located on a side opposite to the supporting wall 911 of the gear frame 91 across the coil 942 in the widthwise direction. The case lateral surface 943*a* is formed to have a fastening hole 943*b*, in which a screw 96 is inserted. The case 943 includes a case lateral surface 943*c* adjoining the supporting wall 911 of the gear frame 91. The case lateral surface 943*c* is located between the supporting wall 911 and the coil 942 in the widthwise direction.

The screw 96 is a fastening member for fixing the case 943 of the solenoid 94 onto the gear frame 91. Optionally, the fastening member for fixing the case 943 onto the gear frame 91 may be a bolt.

The gear frame 91 includes a solenoid-fixing portion 914 protruding leftward from the supporting wall 911. The solenoid-fixing portion 914 is formed to have a fixture hole 914*a*, elongated in the widthwise direction and in which the screw 96 may be screwed. In a state where the screw 96 is inserted through the fastening hole 943*b* in the case lateral surface 943*a*, the screw 96 may be screwed in the fixture hole 914*a* of the solenoid-fixing portion 914. Thereby, the case 943 may be fastened and fixed to the gear frame 91.

If, for example, the fastening hole 943*b* is formed in the case lateral surface 943*c*, which adjoins the supporting wall 911 of the gear frame 91, the screw 96 may be located to protrude toward the supporting wall 911 from the solenoid 94. In this arrangement, the fixture hole 914*a* in which the screw 96 needs to be screwed may be formed rightward with respect to the solenoid 94.

In contrast, in the arrangement where the fastening hole 943*b* is formed through the case lateral surface 943*a* on the side opposite to the supporting wall 911 across the coil 942, the part of the gear frame 91 in which the screw 96 occupies in the widthwise direction may be located within a range of a thickness of the solenoid 94. Therefore, the screw 96 may be prevented from protruding toward the supporting wall 911 from the solenoid 94, and the body 2 may be downsized in the widthwise direction.

Location of Sheet-Ejection Roller Gear

As shown in FIG. 3, the sheet-ejection roller gear 78 is located at a position to coincide in the vertical direction with the solenoid 94. In other words, at least a part of the sheet-ejection roller gear 78 is located to be lower than an upper end of the solenoid 94.

Therefore, compared to an arrangement, in which the sheet-ejection roller gear 78 is located to be entirely higher than the solenoid 94, the body 2 may be downsized in the vertical direction.

Cutout in Switch Arm

Figure 12:
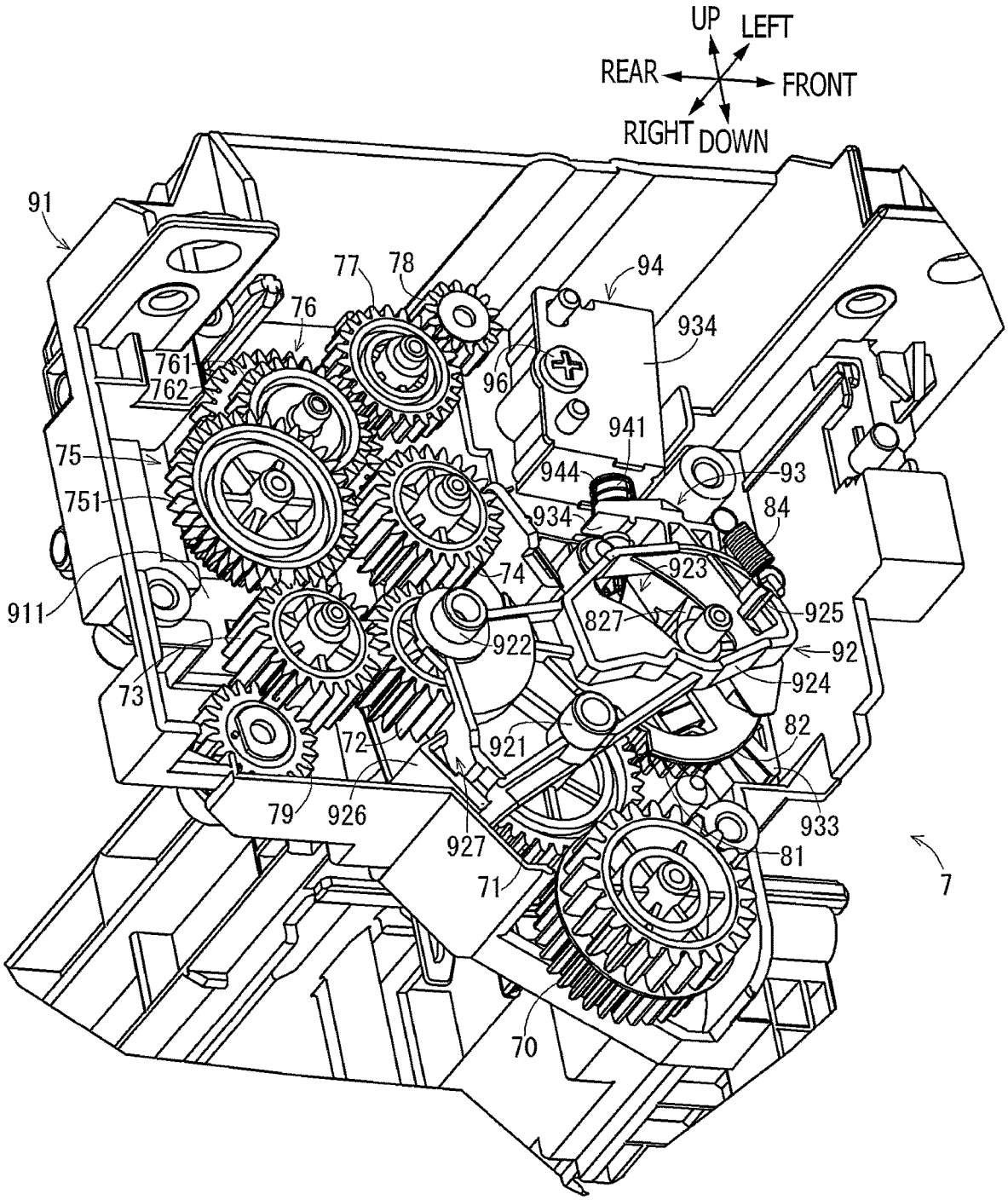
FIG. 12 is a perspective view of a switch arm in the driving device.

As shown in FIGS. 3 and 12, the switch arm 92 includes a corner portion 926 and a cutout 927. The corner portion 926 and the cutout 927 are located at an end on a rear side with respect to the first bearing 921. In the widthwise direction, the cutout 927 is formed leftward with respect to the corner portion 926.

The cutout 927 is formed by cutting a part of the switch arm 92 off in the widthwise direction. In particular, at a position leftward from the switch arm 92, the gear cover 95 (see FIG. 11) covering the switch arm 92 from the left is located, and the cutout 927 is formed by cutting a part of the switch arm 92 on the side toward the gear cover 95 in the widthwise direction. With the cutout 927 formed in the switch arm 92, the corner portion 926 is located rightward from the leftward end of the switch arm 92.

The switch arm 92 has the cutout 927, which is formed by removing the part thereof on the side toward the gear cover 95 in the widthwise direction, thereby preventing collision between the switch arm 92 and the gear cover 95, and the switch arm 92 may move without being interfered by the switch arm 92.

While the invention has been described in conjunction with various example structure outlined above and illustrated in the figures, various alternatives, modifications, variations, improvements, and/or substantial equivalents, whether known or that may be presently unforeseen, may become apparent to those having at least ordinary skill in the art. Accordingly, the example embodiment of the disclosure, as set forth above, is intended to be illustrative of the invention, and not limiting the invention. Various changes may be made without departing from the spirit and scope of the disclosure. Therefore, the disclosure is intended to embrace all known or later developed alternatives, modifications, variations, improvements, and/or substantial equivalents.

What is claimed is:

1. A driving device comprising:

a conveyer roller extending in an axial direction;

a solenoid;

a lever engageable with the solenoid, the lever being movable between a first position, at which the lever is pulled by a pulling effect of the solenoid, and a second position, at which the lever is released from the pulling effect of the solenoid, the lever including a boss protruding in the axial direction;

a first gear configured to transmit a driving force to the conveyer roller;

a pendulum gear movable in conjunction with movement of the lever between a third position, at which the pendulum gear meshes with the first gear, and a fourth position, at which the pendulum gear is disengaged from the first gear; and a frame including a supporting shaft, the supporting shaft extending along the axial direction and being inserted in the boss of the lever, wherein the supporting shaft includes:

a first contact portion contacting the boss of the lever;

a second contact portion contacting the boss of the lever, the second contact portion being separated from the first contact portion in the axial direction; and a separated portion spaced from an inner circumferential surface of the boss and located between the first contact portion and the second contact portion.

2. The driving device according to claim 1, wherein the lever includes a solenoid-contact portion, at which the solenoid contacts the lever, and the solenoid-contact portion is located between the first contact portion and the second contact portion in the axial direction.

3. The driving device according to claim 2, wherein the frame is a gear cover covering the first gear and the pendulum gear.

4. The driving device according to claim 1, further comprising:

a second gear configured to be driven by the driving force input thereto; and a sector gear including teeth portions, the teeth portions being configured to mesh with the second gear, and an engageable portion engageable with the lever, wherein the lever includes a solenoid-contact portion, at which the solenoid contacts the lever, and an engageable claw engageable with the engageable portion of the sector gear, and wherein the engageable claw of the lever is located between the first contact portion and the second contact portion in the axial direction.

5. The driving device according to claim 4, wherein the solenoid-contact portion of the lever protrudes from the boss in a direction intersecting orthogonally with the axial direction, the engageable claw of the lever protrudes from the boss in a direction intersecting orthogonally with the axial direction in a phase different from the solenoid-contact portion, and the lever includes a connecting wall connecting the solenoid-contact portion and the engageable claw.

6. The driving device according to claim 4, wherein the solenoid includes a plunger movable in a direction of the pulling effect to pull the lever, a coil in which the plunger is movably inserted, and a case covering the coil, the case includes a case lateral surface located on a side opposite to the frame across the coil in the axial direction, and a fastening hole, in which a fastening member for fixing the case onto the frame is inserted, is formed on the case lateral surface.

7. The driving device according to claim 1, further comprising an output gear configured to be driven by the driving force transmitted from the first gear, the output gear being connected to the conveyer roller, wherein the output gear is located at a position to coincide in a vertical direction with the solenoid.

8. The driving device according to claim 1, further comprising:

a switch arm supporting the pendulum gear, the switch arm being configured to move the pendulum gear between the third position and the fourth position in conjunction with the movement of the lever; and a cover covering the switch arm from a side opposite across the switch arm to the frame in the axial direction, wherein the switch arm includes a cutout, the cutout being formed by removing a part of the switch arm on a side toward the cover in the axial direction.

9. The driving device according to claim 1, wherein the first contact portion is located at a position closer than the second contact portion to a tip end of the supporting shaft, and a diameter of the second contact portion is larger than a diameter of the first contact portion.

* * * * *